US012426684B2

(12) United States Patent
Campos, II et al.

(10) Patent No.: US 12,426,684 B2
(45) Date of Patent: Sep. 30, 2025

(54) BLADDER FOR A FOOTWEAR SOLE STRUCTURE

(71) Applicant: NIKE, Inc., Beaverton, OR (US)

(72) Inventors: Fidencio Campos, II, Dallas, OR (US); Zachary M. Elder, Portland, OR (US); Jeffery C. Gagatko, II, Portland, OR (US); Roger Paul Murphy, Portland, OR (US); ChunHong Wang, Beaverton, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/019,617

(22) Filed: Jan. 14, 2025

(65) Prior Publication Data

US 2025/0151845 A1 May 15, 2025

Related U.S. Application Data

(60) Continuation of application No. 18/626,008, filed on Apr. 3, 2024, now Pat. No. 12,225,970, which is a division of application No. 17/564,322, filed on Dec. 29, 2021, now Pat. No. 11,974,631.

(60) Provisional application No. 63/131,917, filed on Dec. 30, 2020.

(51) Int. Cl.
*A43B 13/20* (2006.01)
*A43B 13/18* (2006.01)

(52) U.S. Cl.
CPC ..... *A43B 13/206* (2013.01); *A43B 13/186* (2013.01)

(58) Field of Classification Search
USPC ..... 36/29
See application file for complete search history.

(56) References Cited

U.S. PATENT DOCUMENTS

2009/0288312 A1* 11/2009 Dua ..... A63B 41/08 36/153
2010/0325914 A1* 12/2010 Peyton ..... A43B 13/203 36/29
2011/0067264 A1* 3/2011 Doyle ..... A43B 13/206 36/29
2011/0203134 A1* 8/2011 Sartor ..... A43C 15/168 36/28
2011/0277348 A1* 11/2011 Fox ..... A43B 7/142 36/43

(Continued)

*Primary Examiner* — Jameson D Collier
*Assistant Examiner* — Matthew R Marchewka
(74) *Attorney, Agent, or Firm* — Quinn IP Law

(57) ABSTRACT

A sole structure for an article of footwear includes a bladder defining a peripheral chamber and a heel chamber fluidly isolated from the peripheral chamber. The peripheral chamber is configured as an elongated tube, and has a heel portion establishing a rear periphery of the bladder, a lateral arm portion extending from the heel portion and establishing a lateral periphery of the bladder, and a medial arm portion extending from the heel portion and establishing a medial periphery of the bladder. The bladder includes webbing connecting the heel chamber to the peripheral chamber, with the heel chamber disposed between the medial arm portion and the lateral arm portion and forward of the peripheral chamber in a heel region of the bladder. The bladder may include additional forefoot and midfoot chambers having specific shapes.

18 Claims, 14 Drawing Sheets

(56) References Cited

U.S. PATENT DOCUMENTS

| | | | | |
|---|---|---|---|---|
| 2014/0283413 | A1* | 9/2014 | Christensen | A43B 13/20 36/102 |
| 2015/0257483 | A1* | 9/2015 | Meschter | A43B 21/28 36/29 |
| 2016/0073732 | A1* | 3/2016 | Ernst | B29C 51/32 36/28 |
| 2017/0119096 | A1* | 5/2017 | Greene | B29D 35/122 |
| 2017/0265565 | A1* | 9/2017 | Connell | A43B 13/206 |
| 2018/0213887 | A1* | 8/2018 | Brandt | A43B 13/20 |
| 2018/0338579 | A1* | 11/2018 | Cortez | A43B 13/127 |
| 2020/0022454 | A1 | 1/2020 | Eldem et al. | |
| 2020/0154825 | A1* | 5/2020 | Case | A43B 13/206 |
| 2020/0205514 | A1* | 7/2020 | VanDomelen | A43B 13/188 |
| 2020/0405009 | A1* | 12/2020 | Cortez | A43B 13/12 |
| 2021/0345729 | A1* | 11/2021 | Chan | A43B 13/127 |

* cited by examiner

BLADDER FOR A FOOTWEAR SOLE STRUCTURE

CROSS-REFERENCE TO RELATED APPLICATIONS

This application is a continuation of U.S. Nonprovisional application Ser. No. 18/626,008, filed Apr. 3, 2024, which is a divisional of U.S. Nonprovisional application Ser. No. 17/564,322, filed Dec. 29, 2021, now U.S. Pat. No. 11,974,631, issued May 7, 2024, which claims the benefit of priority to U.S. Provisional Application No. 63/131,917, filed Dec. 30, 2020, and each of which is incorporated by reference in its entirety.

TECHNICAL FIELD

The present disclosure generally relates to a bladder for a sole structure of an article of footwear.

BACKGROUND

Footwear typically includes a sole structure configured to be located under a wearer's foot to space the foot away from the ground or floor surface. Polyurethane foam, rubber, or other resilient materials are often used in the sole structure to provide cushioning. Footwear bladders may be used in sole structures, may be inflated with fluid to a desired pressure or may be unpressurized, and may provide resilient cushioning and support.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
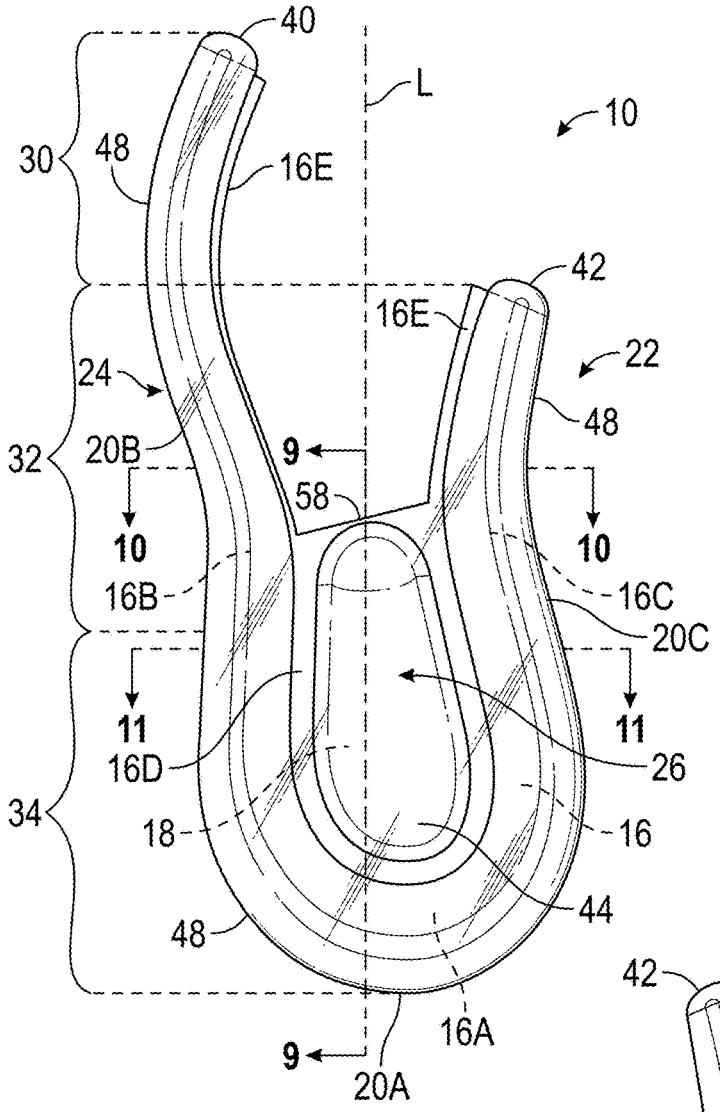
FIG. 1 is a top view of a first embodiment of a bladder within the scope of the disclosure.

The present disclosure generally relates to cushioning elements that may be footwear bladders with multiple fluid-filled chambers having specific shapes, locations, and fluid pressures, which may include pressurized chambers (inflated above ambient pressure) or unpressurized chambers (at ambient pressure) that may provide cushioning and stability to the wearer. While the cushioning elements and bladders disclosed herein may be configured for all footwear sizes, the specific shapes, volumes, geometries, inflation pressures (or ambient pressure, such as if unpressurized) of the various chambers of the bladder, and whether the chambers are fluidly connected or fluidly isolated from one another as shown and described herein may be especially suitable for footwear sizes generally worn by toddlers and children of preschool and grade school age.

In an example, a sole structure for an article of footwear includes a bladder defining a fluid-filled peripheral chamber and a fluid-filled heel chamber fluidly isolated from the peripheral chamber. The peripheral chamber is configured as an elongated tube, and has a heel portion establishing a rear periphery of the bladder, a lateral arm portion extending from the heel portion and establishing a lateral periphery of the bladder, and a medial arm portion extending from the heel portion and establishing a medial periphery of the bladder. The bladder includes webbing connecting the heel chamber to the peripheral chamber, with the heel chamber disposed between the medial arm portion and the lateral arm portion and forward of the peripheral chamber in a heel region of the bladder. The lateral arm portion may have a terminal end in a forefoot region of the bladder, and the medial arm portion may have a terminal end rearward of the terminal end of the lateral arm portion.

The elevation of the peripheral chamber in the heel region of the bladder may be greater than the elevation of the heel chamber. As such, loading of the heel chamber may be secondary to loading of the peripheral chamber. The heel chamber may be configured to provide resilient deformation under dynamic loading, providing a cushioning function whether unpressurized or pressurized.

In some embodiments, the heel chamber is sealed and unpressurized and the peripheral chamber is sealed and unpressurized. As used herein, "unpressurized" means that a chamber is not inflated to a pressure above ambient pressure. A sealed, unpressurized chamber thus contains a gas such as air at ambient pressure. For example, if the bladder is molded by blow molding, the chambers may be unpressurized. In other embodiments, the chambers are pressurized. For example, in some embodiments, the peripheral chamber is sealed and retains fluid at a first fluid pressure, and the heel chamber is sealed and retains fluid at a second fluid pressure different than the first fluid pressure. In an example, the second fluid pressure is lower than the first fluid pressure. For example, in an embodiment in which the bladder is molded by thermoforming, the first and second fluid pressures may be obtained by inflating each the respective chamber to the desired fluid pressure before sealing the chamber to retain the desired fluid pressure.

The bladder may include a perimeter flange extending along the lateral periphery, the rear periphery, and the medial periphery of the bladder. The perimeter flange may be disposed nearer to a lowest extremity of the peripheral chamber at a ground-facing surface of the peripheral chamber than to a highest extremity of the peripheral chamber at a foot-facing surface of the peripheral chamber in the heel region of the bladder along the lateral periphery, the rear periphery, and the medial periphery. This placement of the perimeter flange results in a bladder that is wider in the transverse direction toward the bottom than toward the top, which provides greater stability than a narrower bladder of the same length.

The bladder may be configured so that an inner wall of the peripheral chamber may be steeper than an outer wall of the peripheral chamber, at least directly outward of the heel chamber. The relatively steep inner wall may provide increased stiffness and stability to the peripheral chamber, especially in an unpressurized embodiment, and greater space for the heel chamber to resiliently deform under a dynamic load.

In some embodiments, the heel chamber and the peripheral chamber are the only fluid-filled chambers of the bladder. In other embodiments, in addition to the peripheral chamber and the heel chamber, the bladder may include additional fluid-filled chambers having specific shapes. For example, in one or more implementations the bladder defines at least two additional fluid-filled chambers fluidly isolated from the peripheral chamber. The at least two additional fluid-filled chambers may include three additional fluid-filled chambers, which may be a rear midfoot chamber, a front midfoot chamber, and a forefoot chamber. In some embodiments, the peripheral chamber, the heel chamber, the rear midfoot chamber, the front midfoot chamber, and the forefoot chamber are the only fluid-filled chambers of the bladder. The rear midfoot chamber may be disposed between and connected to the heel chamber and the front midfoot chamber by the webbing. The rear midfoot chamber and the front midfoot chamber may be connected to the lateral arm portion and to the medial arm portion by the webbing. The forefoot chamber may be disposed forward of the front midfoot chamber and may be connected to only the front midfoot chamber and the lateral arm portion by the webbing.

In another implementation, the at least two additional fluid-filled chambers may be only two additional chambers, which may be a rear midfoot chamber and a front midfoot chamber. In such an embodiment, the peripheral chamber, the heel chamber, the rear midfoot chamber, and the front midfoot chamber are the only fluid-filled chambers of the bladder. The rear midfoot chamber may be disposed between and connected to the heel chamber and the front midfoot chamber by the webbing. The rear midfoot chamber and the front midfoot chamber may be connected to the lateral arm portion and to the medial arm portion by the webbing.

In an embodiment that includes the at least two additional chambers, the bladder may include a groove extending between the medial arm portion and the front midfoot chamber, between the medial arm portion and the rear midfoot chamber, between a rear of the rear midfoot chamber and the heel chamber, between the rear midfoot chamber and the lateral arm portion, and between the front midfoot chamber and the lateral arm portion. For example, the groove may be molded into the bladder. The groove may serve as a guide at which the bladder may be optionally trimmed to remove the at least two additional chambers, such as the rear midfoot chamber, the front midfoot chamber, and, where included, the forefoot chamber. The groove thus enables efficiencies in manufacturing, as two different bladder configurations can ultimately be obtained from one mold.

The chambers of the bladder may be shaped and configured specifically to correspond with expected loading patterns of a wearer's foot. In an example, a periphery of the rear midfoot chamber may be a convex, irregular quadrilateral with rounded corners, a rear side, a front side longer than the rear side, a medial side, and a lateral side longer than the medial side. A periphery of the front midfoot chamber may be a convex, irregular quadrilateral with rounded corners, a rear side, a front side longer than the rear side, a medial side, and a lateral side shorter than the medial side. Configuring the chambers with corners may limit the tendency of the chamber to balloon in comparison to a rounded chamber, resulting in a more uniform underfoot feel.

The rear side of the front midfoot chamber may be parallel with the front side of the rear midfoot chamber. A periphery of the forefoot chamber may include a lateral side extending parallel with the lateral arm portion, a rear side disposed forward of the terminal end of the medial arm portion and extending forwardly from a lateral extent to a medial extent, and a front side extending rearwardly from a lateral extent to a medial extent. A forward edge of the bladder may extend along the front side of the front midfoot chamber and along the front side of the forefoot chamber. The forward edge of the bladder may be rearward of a line tangent to the terminal end of the lateral arm portion and the terminal end of the medial arm portion. A majority of the forefoot chamber may be disposed between the lateral arm portion of the peripheral chamber and a longitudinal midline of the bladder. The lateral side of the forefoot chamber, the lateral side of the front midfoot chamber, and the lateral side of the rear midfoot chamber may be equidistant from the lateral arm portion. The medial side of the front midfoot chamber and the medial side of the rear midfoot chamber may be equidistant from the medial arm portion.

The various chambers of the bladder may be fluidly isolated or in fluid communication with one another, offering various combinations of fluid pressures (at or above ambient pressure) in the chambers to provide different corresponding cushioning profiles. For example, a first channel may extend between and fluidly connect the forefoot chamber and the front midfoot chamber, and/or a second channel may extend between and fluidly connect the front midfoot chamber and the rear midfoot chamber, and/or a third channel may extend between and fluidly connect the rear midfoot chamber and the heel chamber. Each of the forefoot chamber, the front midfoot chamber, and the rear midfoot chamber may be fluidly isolated from one another and from the heel chamber, for example, if these channels are sealed. Alternatively, one or more of the heel chamber, the forefoot chamber, the front midfoot chamber, and the rear midfoot chamber may be in fluid communication with one another by not sealing one or more of the channels. The bladder may include a single fill port extending from the front side of the front midfoot chamber to be used during inflation of the bladder (or blow molding of the bladder in blow molded embodiments), or the bladder may include more than one fill port.

When assembled in an article of footwear, an outsole may underlie the bladder, a midsole layer, such as a foam layer, may overlie the bladder, and a footwear upper may overlie the bladder and be secured to the bladder or to another component of the sole structure, such as the midsole layer. In some embodiments, the midsole layer may overlie the bladder between the upper and the bladder.

An exterior surface of the bladder may be exposed between the upper and the outsole at the medial arm portion, the lateral arm portion, and the heel portion both for aesthetic purposes and to allow the sides of the bladder to elastically deform. In embodiments with an overlying midsole layer, the exterior surface of the bladder may be exposed between the midsole layer and the outsole at the medial arm portion, the lateral arm portion, and the heel portion. For example, the entire exterior surface of the bladder may be exposed between the midsole layer and the outsole at the medial arm portion, the lateral arm portion, and the heel portion.

In some embodiments, the bladder may be blow molded and the various chambers unpressurized. In other embodiments, the bladder may be thermoformed and the various chambers pressurized to different relative pressures. The geometry and/or volume of the various chambers may be different in a blow molded bladder than in a thermoformed bladder to account for the particular advantages and limitations of each forming process.

Within the scope of the disclosure, an article of footwear may incorporate any one of the sole structures including any one of the bladders disclosed herein.

Within the scope of the disclosure, an article of footwear may comprise a sole structure that includes a cushioning element having a heel portion in a heel region of the sole structure and establishing a rear periphery of the cushioning element, a lateral arm portion extending from the heel portion and establishing a lateral periphery of the cushioning element, and a medial arm portion extending from the heel portion and establishing a medial periphery of the cushioning element. A terminal end of the medial arm portion may be in a forefoot region of the sole structure and a terminal end of the lateral arm portion may be in the forefoot region of the sole structure further forward than the terminal end of the medial arm portion. The cushioning element may comprise a foam material or another resiliently deformable material instead of a bladder with a fluid-filled chamber in some embodiments. In other embodiments, the cushioning element may be a bladder. The bladder may include a fluid-filled peripheral chamber that includes the medial arm portion, the lateral arm portion, and the heel portion.

In some embodiments of the article of footwear, an exterior side surface of the cushioning element may be exposed along the lateral arm portion from the heel portion to the terminal end of the lateral arm portion. The exterior side surface of the cushioning element may also be exposed along the medial arm portion from the heel portion to the terminal end of the medial arm portion. Additionally, the exterior side surface of the cushioning element may be exposed along the heel portion.

In some embodiments of the article of footwear, the cushioning element may be characterized by an absence of a medial forefoot portion.

In some embodiments of the article of footwear, the cushioning element may include a perimeter flange extending along the lateral periphery, the rear periphery, and the medial periphery of the cushioning element, and the perimeter flange may be disposed nearer to a lowest extremity of the cushioning element at a ground-facing surface of the cushioning element than to a highest extremity of the cushioning element at a foot-facing surface of the cushioning element in the heel region of the cushioning element along the lateral periphery, the rear periphery, and the medial periphery.

In some embodiments of the article of footwear, the sole structure may include an outsole secured to a ground-facing surface of the cushioning element along the medial arm portion, the lateral arm portion, and the heel portion; and wherein the outsole extends to the perimeter flange. In some embodiments, the outsole may terminate at the perimeter flange.

In some embodiments of the article of footwear, the sole structure may include a midsole layer disposed in the forefoot region forward of the terminal end of the medial arm portion and forward of the terminal end of the lateral arm portion. The midsole layer may also be disposed in a midfoot region of the sole structure and in the heel region and may extend over the lateral arm portion, the medial arm portion, and the heel portion without covering the exterior side surface.

In some embodiments of the article of footwear, the sole structure may include an outsole secured to a ground-facing surface of the cushioning element along the medial arm portion, the lateral arm portion, and the heel portion, and secured to the midsole layer forward of the terminal end of the medial arm portion and forward of the terminal end of the lateral arm portion.

In some embodiments of the article of footwear, the article of footwear may include an upper that overlies the midsole layer, and the midsole layer may be between the upper and the cushioning element.

A method of manufacturing footwear may include molding polymeric material to form a bladder for a sole structure of an article of footwear, the bladder defining a fluid-filled peripheral chamber and a fluid-filled heel chamber. The peripheral chamber may be configured as an elongated tube, and may have a heel portion establishing a rear periphery of the bladder, a lateral arm portion extending from the heel portion and establishing a lateral periphery of the bladder, and a medial arm portion extending from the heel portion and establishing a medial periphery of the bladder. The bladder may include webbing connecting the heel chamber to the peripheral chamber, with the heel chamber disposed between the medial arm portion and the lateral arm portion and forward of the peripheral chamber in a heel region of the bladder. The method may further include sealing the peripheral chamber and the heel chamber so that the peripheral chamber and the heel chamber are fluidly isolated from one another.

In some embodiments, the method of manufacturing footwear may include inflating and then sealing the peripheral chamber, and inflating and then sealing the heel chamber (in either order) so that the peripheral chamber retains fluid at a first fluid pressure and the heel chamber retains fluid at a second fluid pressure different than the first fluid pressure.

Additionally, the method of manufacturing footwear may include trimming the polymeric material at a perimeter flange extending along the lateral periphery, the rear periphery, and the medial periphery of the bladder. The perimeter flange may be disposed nearer to a lowest extremity of the peripheral chamber at a ground-facing surface of the peripheral chamber than to a highest extremity of the peripheral chamber at a foot-facing surface of the peripheral chamber in the heel region of the bladder along the lateral periphery, the rear periphery, and the medial periphery.

In embodiments in which the bladder defines the rear midfoot chamber and the front midfoot chamber fluidly isolated from the peripheral chamber and a groove extending between the medial arm portion and the front midfoot chamber, between the medial arm portion and the rear midfoot chamber, between a rear of the rear midfoot chamber and the heel chamber, between the rear midfoot chamber and the lateral arm portion, and between the front midfoot chamber and the lateral arm portion, the method of manufacturing footwear may include trimming the bladder along the groove to remove the at least two additional chambers from the bladder.

The above features and advantages and other features and advantages of the present teachings are readily apparent from the following detailed description of the modes for carrying out the present teachings when taken in connection with the accompanying drawings.

Figure 2:
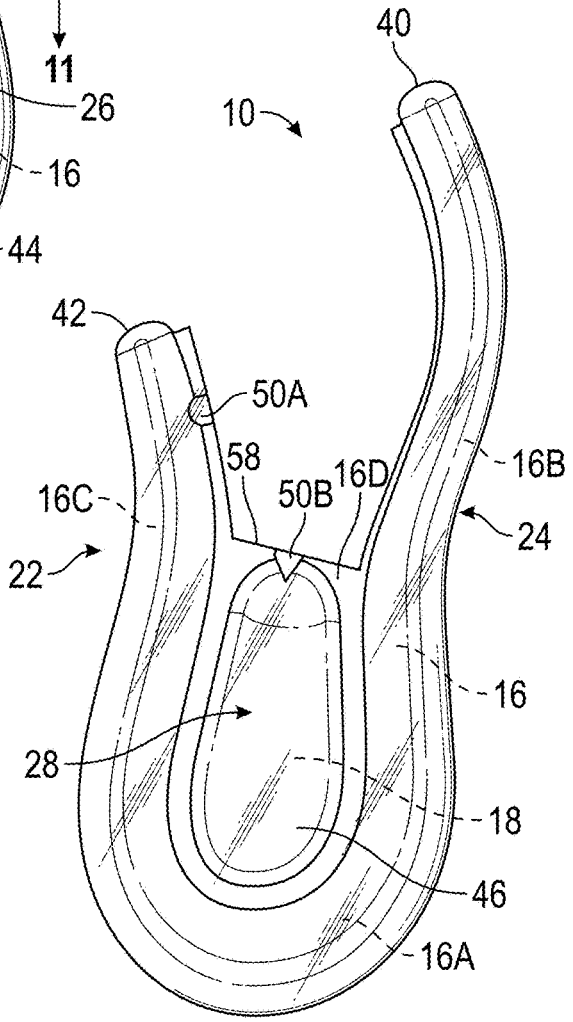
FIG. 2 is a bottom view of the bladder of FIG. 1.

Referring to the drawings, wherein like reference numbers refer to like components throughout the views, FIG. 1 is a top view of a first embodiment of a bladder 10 within the scope of the disclosure. FIG. 2 is a bottom view of the bladder 10. The bladder 10 is configured to be used as a component of a sole structure 12 of an article of footwear 14, as discussed with respect to FIGS. 3-4. The bladder 10 includes a polymeric material that is configured to define a peripheral chamber 16 and a heel chamber 18. As used herein, a chamber is a fluid-filled cavity, and, as discussed herein, the bladder 10 is configured so that the chambers 16, 18 may be filled with gas (such as air or nitrogen) and sealed to retain the gas at a predetermined pressure, which may be ambient pressure or a pressure above ambient.

The peripheral chamber 16 is configured as an elongated tube, and has a heel portion 16A, a lateral arm portion 16B, and a medial arm portion 16C. The heel portion 16A establishes a rear periphery 20A of the bladder 10. The lateral arm portion 16B extends from the heel portion 16A and establishes a lateral periphery 20B of the bladder 10. The medial arm portion 16C extends from the heel portion 16A and establishes a medial periphery 20C of the bladder 10. The bladder 10 also includes webbing 16D connecting the heel chamber 18 to the peripheral chamber 16, and flanges 16E and 48 discussed herein.

The bladder 10 has a medial side 22, a lateral side 24, a foot-facing surface 26, and a ground-facing surface 28 opposite from the foot-facing surface 26. The foot-facing surface 26 may also be referred to as a first side or top side, and the ground-facing surface 28 may be referred to as a second side or bottom side. The foot-facing surface 26 generally faces upward when the bladder 10 is assembled in the article of footwear 14, and the ground-facing surface 28 generally faces downward. The medial side 22 and the lateral side 24 also describe the medial side and the lateral side, respectively, of the sole structure 12 and the article of footwear 14 in FIGS. 3 and 4.

The bladder 10 includes a forefoot region 30, a midfoot region 32, and a heel region 34. The heel region 34 generally corresponds with rear portions of a human wearer's foot, including the calcaneus bone, with the foot corresponding in size to the article of footwear 14. The forefoot region 30 generally includes portions of the bladder 10 corresponding with the toes and the joints connecting the metatarsals with the phalanges of the foot. The midfoot region 32 generally corresponds with an arch area of the foot, including the navicular joint, and extends from the forefoot region 30 to the heel region 34. The bladder 10 and the article of footwear 14 are shown configured for a left foot. However, the description of the bladder 10 applies equally to a mirror-image bladder configured for a right foot.

The heel chamber 18 is disposed between the medial arm portion 16C and the lateral arm portion 16B, forward of the heel portion 16A of the peripheral chamber 16, and mainly in the heel region 34 of the bladder 10. The heel chamber 18 and the peripheral chamber 16 are the only fluid-filled chambers of the bladder 10. The lateral arm portion 16B has a terminal end 40 in the forefoot region 30, and the medial arm portion 16B has a terminal end 42 rearward of the terminal end 40. The terminal end 40 is the foremost extent of the bladder 10 and is also the foremost extent of the lateral arm portion 16B. The terminal end 42 is the foremost extent of the medial arm portion 16C. The terminal end 42 may be in the midfoot region 32 of the bladder 10, or may be in a rear portion of the forefoot region 30. The webbing 16D terminates rearward of the forefoot region 30. Accordingly, the forefoot region 30 includes only the lateral arm portion 16B. No part of the bladder 10 is disposed on a medial side of a longitudinal midline L of the bladder 10 in the forefoot region 30. The bladder 10 is thus characterized by an absence of a medial forefoot portion, due to the location of the terminal end 42 and the absence of webbing in the forefoot region at the medial side 22.

In various embodiments, the bladder 10 and the other bladder embodiments shown and described herein may be blow molded, welded by radio-frequency welding, or thermoformed in a mold. In the embodiment shown, the bladder 10 is thermoformed from two sheets, including a first polymeric sheet 44 and a second polymeric sheet 46. The first polymeric sheet 44 may be referred to as a top sheet as it establishes the foot-facing surface 26. The second polymeric sheet 46 may be referred to as the bottom sheet as it establishes the ground-facing surface 28. As best shown in FIGS. 5-11, the first polymeric sheet 44 is secured to the second polymeric sheet 46 at a perimeter flange 48 to enclose the peripheral chamber 16. A transversely inward side of the peripheral chamber 16 and the heel chamber 18 are enclosed by the webbing 16D as shown at an edge 58 of the webbing 16D in FIG. 9. The webbing 16D includes portions of the bladder 10 where the first polymeric sheet 44 is bonded to the second polymeric sheet 46 transversely inward of the peripheral chamber 16. The bladder 10 may be trimmed at the portions of the webbing 16D extending along the inner sides of the arm portions 16B, 16C and at the edge 58, so that the only a flange 16E remains at these portions. When the polymeric sheets 44, 46 are secured together at the perimeter flange 48 and at the webbing 16D, and one or more fill ports described herein are sealed, the polymeric bladder 10 is sealed, and the first polymeric sheet 44 and the second polymeric sheet 46 retain a fluid in the peripheral chamber 16 and the heel chamber 18. As used herein, a "fluid" filling the chambers 16, 18 may be a gas, such as air, nitrogen, another gas, or a combination thereof.

Accordingly, the first polymeric sheet 44 and the second polymeric sheet 46 define the peripheral chamber 16, the heel chamber 18, the webbing 16D, the flange 16E, and the perimeter flange 48 at the medial periphery 20C, the lateral periphery 20B, and the rear periphery 20A, and any remaining flange 16E, and the first polymeric sheet 44 and the second polymeric sheet 46 are bonded to one another at the webbing 16D, the perimeter flange 48, and the flange 16E and separated from one another at the heel chamber 18 and the peripheral chamber 16.

The first and second polymeric sheets 44, 46 can be a variety of polymeric materials that can resiliently retain a fluid such as nitrogen, air, or another gas. Examples of polymeric materials for the first and second polymeric sheets 44, 46 include thermoplastic urethane, polyurethane, polyester, polyester polyurethane, and polyether polyurethane. Moreover, the first and second polymeric sheets 44, 46 can each be formed of layers of different materials including polymeric materials. In one embodiment, each of the first and second polymeric sheets 44, 46 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 44, 46 are disclosed in U.S. Pat. Nos. 4,183,156 and 4,219,945 to Rudy which are incorporated by reference in their entireties. Further suitable materials for the first and second polymeric sheets 44, 46 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder 10, engineering properties such as tensile strength, stretch properties, fatigue characteristics, dynamic modulus, and loss tangent can be considered. For example, the thicknesses of the first and second polymeric sheets 44, 46 used to form the bladder 10 can be selected to provide these characteristics.

As best shown in FIG. 2, the bladder 10 has two separate fill ports 50A and 50B. The fill ports 50A, 50B are initially unsealed tubular channels between the first and second polymeric sheets 44, 46 that are subsequently sealed after the chambers 16, 18 are filled with fluid (e.g., by inflation). The fill port 50A communicates with the peripheral chamber 16 and is used during manufacturing of the bladder 10 to access the peripheral chamber 16 and, in a pressurized embodiment, to inflate and fill it with fluid to a predetermined pressure. The fill port 50B communicates with the heel chamber 18 and is used during manufacturing of the bladder 10 to access the heel chamber 18 and, in a pressurized embodiment, to inflate and fill it with fluid to a predetermined pressure, which may be the same or a different pressure than that of the peripheral chamber 16. Alternatively, the bladder 10 could be configured with only a single fill port (either fill port 50A or fill port 50B) and with a channel extending between and initially fluidly connecting the chambers 16 and 18, but sealed during the inflation process to fluidly isolate the chambers 16, 18 from one another and enable two different pressures in the chambers 16, 18.

In FIGS. 1 and 2, the fill ports 50A, 50B are shown sealed so that the filled chambers 16, 18 retain the fluid at the predetermined pressure(s). The peripheral chamber 16 and the heel chamber 18 are fluidly isolated from one another in the bladder 10. Stated differently, there are no open (unsealed) channels crossing the webbing 16D to connect the chambers 16, 18. Accordingly, the chambers 16, 18 may be filled with and retain fluid at different predetermined pressures. In the embodiment of the bladder 10 shown in FIGS. 1-2, for example, the peripheral chamber 16 is sealed and retains fluid at a first fluid pressure and the heel chamber 18 is sealed and retains fluid at a second fluid pressure different than the first fluid pressure. In one non-limiting example, the second fluid pressure in the heel chamber 18 may be ambient pressure or a pressure up to 20 pounds per square inch more than ambient pressure, while the first fluid pressure in the peripheral chamber 16 may be more than 5 pounds per square inch above ambient pressure, up to 30 pounds per square inch above ambient pressure. In a specific example, the peripheral chamber 16 may be inflated to and sealed to retain fluid at 15 pounds per square inch above ambient pressure, and the heel chamber 18 may be inflated to and sealed to retain fluid at 5 pounds per square inch above ambient pressure. In another specific example, the peripheral chamber 16 may be inflated to and sealed to retain fluid at 20 pounds per square inch above ambient pressure, and the heel chamber 18 may be inflated to and sealed to retain fluid at 5 pounds per square inch above ambient pressure. The second fluid pressure is less than the first fluid pressure in the embodiment shown. This enables the relatively high pressure peripheral chamber 16 to be relatively firm, providing good peripheral support, such as at the medial and lateral sides 22, 24 while also providing softer cushioning in the center of the heel region 34 under the wearer's heel at the relatively low pressure heel chamber 18.

Figure 3:
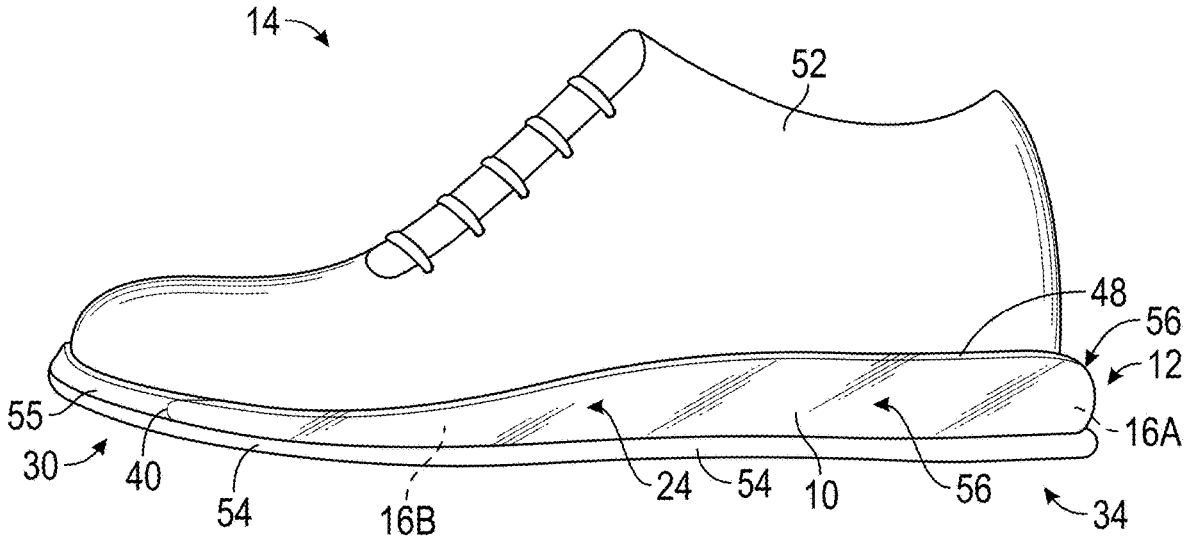
FIG. 3 is a lateral side view of an article of footwear including a sole structure with the bladder of FIG. 1.
Figure 4:
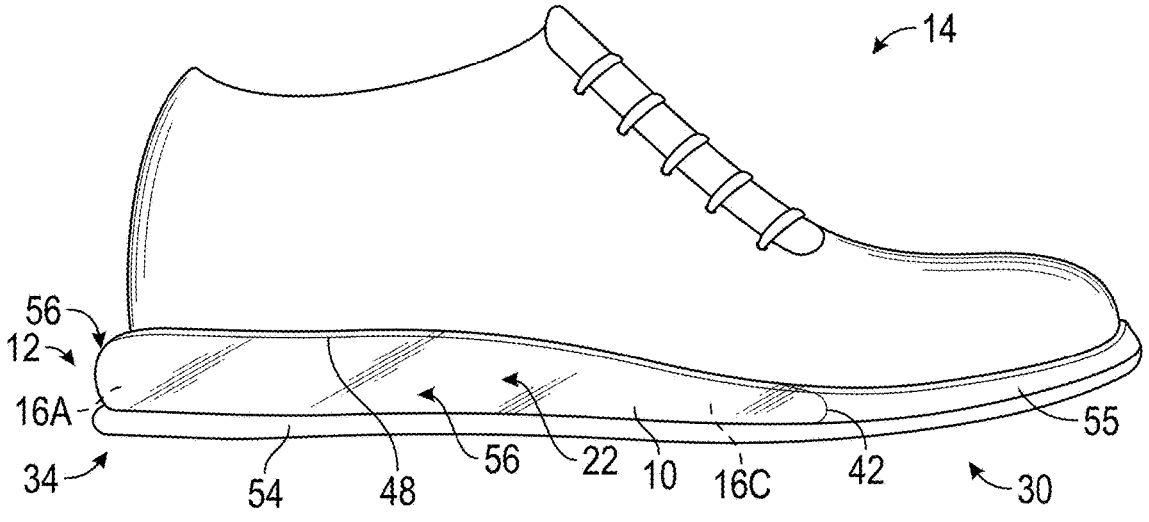
FIG. 4 is a medial side view of the article of footwear of FIG. 3.

Referring to FIGS. 3-4, the article of footwear 14 is shown with an upper 52 secured to the sole structure 12. In addition to the bladder 10, the sole structure 12 includes an outsole 54 underlying the bladder 10. For example, the outsole 54 may be secured to the ground-facing surface 28 of FIG. 2 and the upper 52 may be secured to the foot-facing surface 26. Alternatively, one or more sole layers, such as midsole layers of foam or another material may be disposed between the upper 52 and the bladder 10 and/or between the bladder 10 and the outsole 54.

FIGS. 3 and 4 show a midsole layer 55 disposed in the forefoot region 30 extending rearward to the terminal ends 40, 42. The midsole layer 55 may also extend between the arm portions 16B, 16C back to the edge 58 of the webbing 16D shown just forward of the heel chamber 18 in FIGS. 1 and 2, and may further extend over the foot-facing surface 26 of the bladder 10 rearward of the edge 58 in some embodiments. The midsole layer 55 may be, for example, a foam material and can have a different compressive stiffness than the compressive stiffnesses of the inflated heel chamber 18 and peripheral chamber 16.

The bladder 10 is visible at the lateral side 24 of the footwear 14, as shown in FIG. 3, at the medial side 22 as shown in FIG. 4, and at the rear of the heel region 34 as is evident in both views. This visibility is possible because the upper 52 and the outsole 54 are arranged so that an exterior surface 56 of the bladder 10 (also referred to herein as an exterior side surface 56) is exposed between the upper 52 and the outsole 54 at the medial arm portion 16C, the lateral arm portion 16B, and the heel portion 16A.

Figure 5:
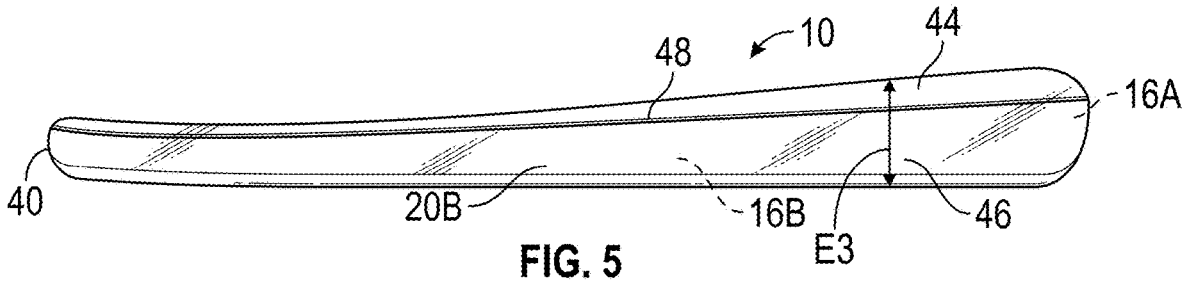
FIG. 5 is a lateral side view of the bladder of FIG. 1.
Figure 6:
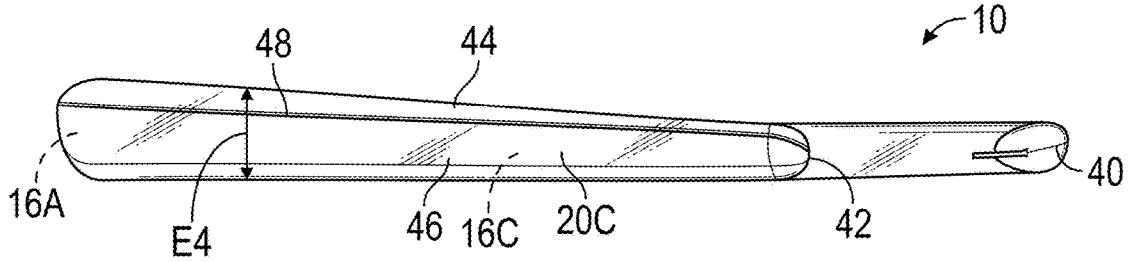
FIG. 6 is a medial side view of the bladder of FIG. 1.
Figure 7:
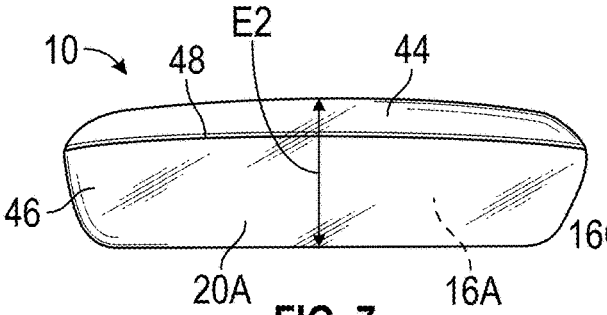
FIG. 7 is a rear view of the bladder of FIG. 1.

FIG. 5 is a lateral side view of the bladder 10 of FIG. 1 showing the lateral arm portion 16B extending from the heel portion 16A to the terminal end 40. FIG. 6 is a medial side view of the bladder 10, showing the medial arm portion 16C extending from the heel portion 16A to the terminal end 42, which is rearward of the terminal end 40. FIG. 7 is a rear view of the bladder 10 showing the rear of the heel portion 16A. The perimeter flange 48 connects the first polymeric sheet 44 and the second polymeric sheet 46 and extends around the entire outer exterior, as is evident in FIGS. 5-7.

With reference to FIGS. 1 and 2, the terminal end 40 is disposed further forward in the forefoot region 30 than the medial end 42. This longer length of the lateral arm portion 16B in comparison to the medial arm portion 16C lends stability to the bladder 10 and allows for more visibility of the bladder 10. The medial end 42 being further rearward allows for more flexibility, as the bladder 10 will bend under the metatarsal heads of the foot during dorsiflexion. The midsole layer 55 is disposed under the metatarsal heads and may be more flexible than the arm portions 16B, 16C. With the positioning of the terminal end 40 and the terminal end 42 rearward of the foremost extent of the sole structure 12 of FIGS. 3 and 4, and the absence of the bladder 10 in the forefoot region at the medial side 22, the bladder 10 may be referred to as a three-quarter length bladder. The additional bladders 110, 210, 310, 410, and 510 disclosed herein are also three-quarter length bladders.

Figure 8:
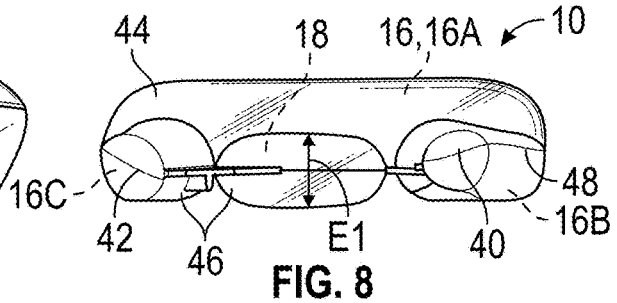
FIG. 8 is a front view of the bladder of FIG. 1.
Figure 9:
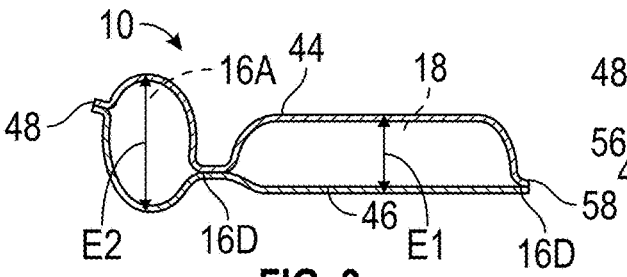
FIG. 9 is a cross-sectional view of the bladder of FIG. 1 taken at lines 9-9 in FIG. 1.

It is apparent in FIGS. 5 and 6 that the lateral arm portion 16B and the medial arm portion 16C of the peripheral chamber 16 taper in height from the heel portion 16A to the respective terminal ends 40, 42, and that the peripheral chamber 16 is greatest in height at the heel portion 16A. FIG. 8 is a front view of the bladder 10 and shows both the portions 16A, 16B, and 16C of the peripheral chamber 16 and also shows the heel chamber 18. FIG. 9 is a cross-sectional view of the bladder 10 taken at lines 9-9 in FIG. 1. It is evident from FIGS. 5-9 that the maximum elevation E1 of the heel chamber 18 is less than the elevation E2 of the heel portion 16A of the peripheral chamber 16 and is less than the elevation E3 of the medial arm portion 16C and the elevation E4 of the lateral arm portion 16B directly transversely laterally outward of the heel chamber 18. The elevations E2, E3, and E4 may be taken at any location along the heel portion 16A, the lateral arm portion 16B, and the medial arm portion 16C, respectively, that is directly outward of and bordering the heel chamber 18. The elevations E1, E2, E3, E4 are when the bladder 10 is in a static state (not under dynamic loading). Due to this height differential between the heel chamber 18 and the peripheral chamber 16, as well as the tapering height of the peripheral chamber 16 from the heel portion 16A to the terminal ends 40, 42, during wear, the article of footwear 14 will typically first make contact with the ground at the heel region 34, and the much taller peripheral chamber 16 will be loaded before the heel chamber 18. In an embodiment in which the heel chamber 18 is at a lower pressure than the peripheral chamber 16, as the foot loads the heel chamber 18, it may resiliently deform under loading, providing cushioning under the calcaneus bone.

Figure 10:
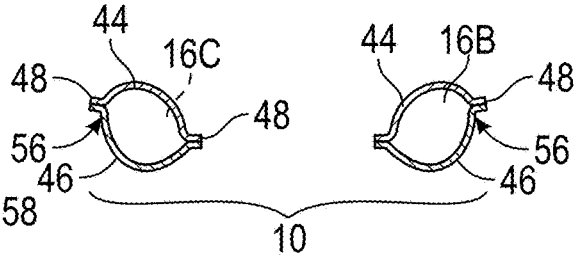
FIG. 10 is a cross-sectional view of the bladder of FIG. 1 taken at lines 10-10 in FIG. 1.
Figure 11:
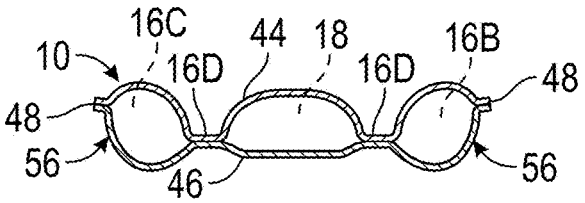
FIG. 11 is a cross-sectional view of the bladder of FIG. 1 taken at lines 11-11 in FIG. 1.

FIG. 10 is a cross-sectional view of the bladder 10 taken at lines 10-10 in FIG. 1, and FIG. 11 is a cross-sectional view of the bladder 10 taken at lines 11-11 in FIG. 1. The perimeter flange 48 is higher at the exterior side surface 56 of the bladder 10 than at transversely inward side surfaces of the arm portions 16B, 16C, causing the first polymeric sheet 44 to slope downward and transversely inward as shown to better wrap around and support the periphery of the foot.

FIGS. 12-21 show an alternative embodiment of a bladder 110 that has many of the same features as discussed with respect to the bladder 10, which features are referred to with like reference numbers. As shown, the bladder 110 is thermoformed from first and second polymeric sheets 44, 46. The bladder 110 can be used in the article of footwear 14 of FIGS. 3 and 4 instead of the bladder 10, with the outsole 54 secured to the ground-facing surface 28 shown in FIG. 13 and the upper 52 secured to the foot-facing surface 26 shown in FIG. 12, or with one or more sole layers, such as midsole layers of foam or another material disposed between the upper 52 and the bladder 110 and/or between the bladder 110 and the outsole 54. A midsole layer like midsole layer 55 may be disposed in the forefoot region 30 extending rearward to the terminal ends 40, 42 and the edge 158 of the webbing 16D shown in FIGS. 12 and 13, and may further extend over the foot-facing surface 26 of the bladder 110 and even rearward of the edge 158 in some embodiments. The midsole layer 55 may be, for example, a foam material having a different compressive stiffness than the compressive stiffness of the inflated forefoot chamber 64. For example, the foam may be softer for providing cushioning under the metatarsophalangeal joint.

Figure 12:
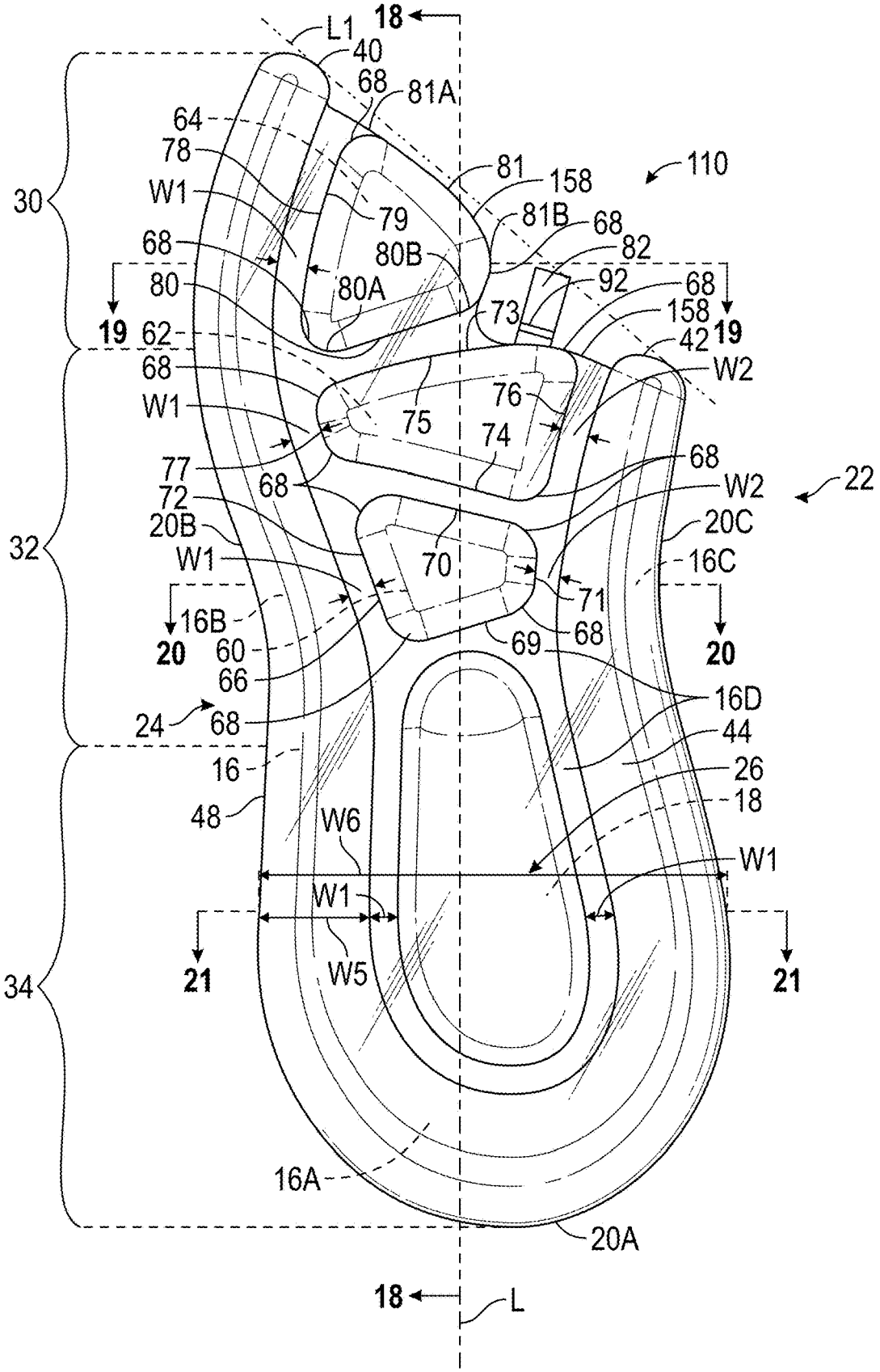
FIG. 12 is a top view of an alternative embodiment of a bladder within the scope of the disclosure.
Figure 13:
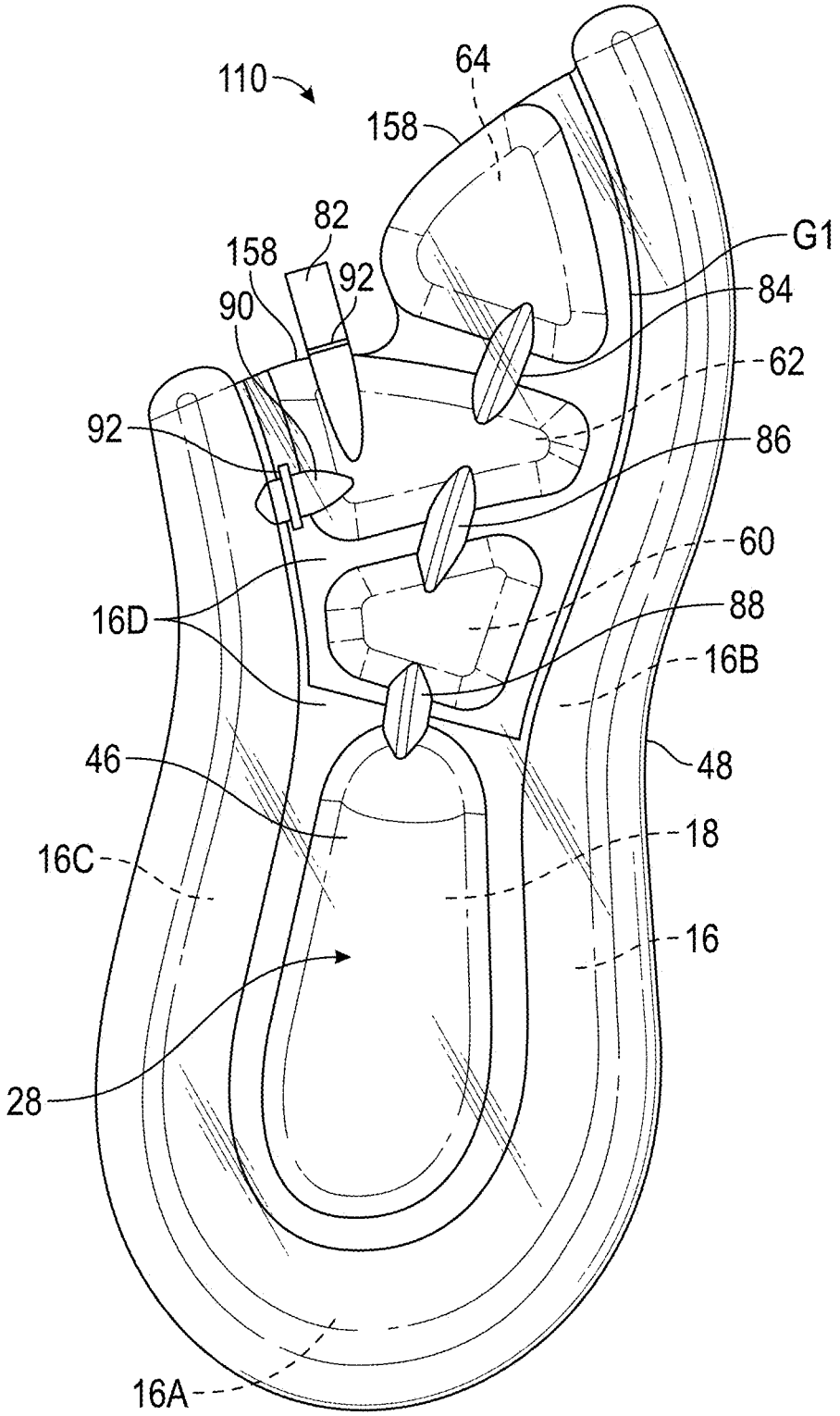
FIG. 13 is a bottom view of the bladder of FIG. 12.

FIG. 12 shows the top view of the bladder 110, including the peripheral chamber 16 and the heel chamber 18, and the foot-facing surface 26 defined by the first polymeric sheet 44. FIG. 13 shows the bottom view of the bladder 110 with the ground-facing surface 28. The bladder 110 defines three additional chambers 60, 62, and 64 that are fluidly isolated from the peripheral chamber 16. The three additional chambers include a rear midfoot chamber 60, a front midfoot chamber 62, and a forefoot chamber 64. The peripheral chamber 16, the heel chamber 18, the rear midfoot chamber 60, the front midfoot chamber 62, and the forefoot chamber 64 are the only fluid-filled chambers of the bladder 110. The rear midfoot chamber 60 and the front midfoot chamber 62 are disposed in the midfoot region 32. The rear midfoot chamber 60 is disposed between and connected to the heel chamber 18 and the front midfoot chamber 62 by the webbing 16D formed by the bonded portions of the first polymeric sheet 44 and the second polymeric sheet 46. The rear midfoot chamber 60 and the front midfoot chamber 62 are connected to the lateral arm portion 16B and the medial arm portion 16C by the webbing 16D. The forefoot chamber 64 is disposed forward of the front midfoot chamber 62 and is disposed in the forefoot region 30. The forefoot chamber 64 is connected to only the front midfoot chamber 62 and to the lateral arm portion 16B by the webbing 16D. Accordingly, unlike the bladder 10, the bladder 110 has at least one fluid-filled chamber transversely inward of the peripheral chamber 16 in each of the heel region 34, the midfoot region 32, and the forefoot region 30. Like bladder 10, the bladder 110 is characterized by an absence of a medial forefoot portion.

In addition to the peripheral chamber 16 and the heel chamber 18, the chambers 60, 62, and 64 are shaped and positioned to support how a foot typically loads an underlying sole structure (e.g., corresponding with expected loading patterns of a wearer's foot) and to comfortably underlie the foot. Like the heel chamber 18, the chambers 60, 62, and 64 are lower in elevation than the peripheral chamber 16.

Additionally, the chambers 60, 62, and 64 each include multiple corners 68 and relatively straight sides between adjacent corners 68. In comparison to a more rounded perimeter, the polygon-shaped perimeter of each chamber 60, 62, and 64 helps to maintain a relatively low elevation of the chambers 60, 62, 64, preventing a ballooning that could otherwise occur during inflation in a pressurized version. This helps to maintain a relatively flat top surface of each chamber 60, 62, and 64, providing greater comfort under foot and avoiding pressure points.

For example, a periphery 66 of the rear midfoot chamber 60 is a convex, irregular quadrilateral with rounded corners 68, a rear side 69, a front side 70 longer than the rear side 69, a medial side 71, and a lateral side 72 longer than the medial side 71. A periphery 73 of the front midfoot chamber 62 is a convex, irregular quadrilateral with rounded corners 68, a rear side 74, a front side 75 longer than the rear side 74, a medial side 76, and a lateral side 77 shorter than the medial side 76. Additionally, the rear side 74 of the front midfoot chamber 62 is parallel with the front side 70 of the rear midfoot chamber 60. A periphery 78 of the forefoot chamber 64 includes rounded corners 68, a lateral side 79 extending parallel with the lateral arm portion 16B, a rear side 80 disposed forward of the terminal end 42 of the medial arm portion 16C and extending forwardly from a lateral extent 80A to a medial extent 80B, and a front side 81 extending rearwardly from a lateral extent 81A to a medial extent 81B. A majority of the forefoot chamber 64 is disposed between the lateral arm portion 16B of the peripheral chamber 16 and the longitudinal midline L of the bladder 110.

By configuring the chambers 60, 62, 64 with corners 68 and relatively straight sides of adjacent chambers (adjacent chambers 60 and 62, and adjacent chambers 62 and 64) generally parallel with one another, in addition to preventing excessive ballooning of the chambers 60, 62, and 64 in the vertical direction, as discussed above, a maximum amount of space in the longitudinal and transverse directions between the lateral arm portion 16B and the medial arm portion 16C can be occupied by the chambers 60, 62, and 64 to enable the chambers 60, 62, and 64 to underlie more of the foot to maximize the cushioning and support benefits provided by the chambers 60, 62, 64.

The forward edge 158 of the bladder 110 extends along the front side 75 of the front midfoot chamber 62 and along the front side 81 of the forefoot chamber 64. The forward edge 158 may be a flange created by the webbing 16D that may be trimmed just forward of the front sides 75, 81. The forward edge 158 of the bladder 110 is rearward of a line L1 (shown in phantom) that is tangent to the terminal end 40 of the lateral arm portion 16B and to the terminal end 42 of the medial arm portion 16C. With this configuration, the bladder 110 is characterized by an absence of a medial forefoot portion.

As shown in FIG. 12, the lateral side 79 of the forefoot chamber 64, the lateral side 77 of the front midfoot chamber 62, and the lateral side 72 of the rear midfoot chamber 60 are equidistant from the lateral arm portion 16B. Stated differently, the width W1 of the portion of the webbing 16D between the lateral arm portion 16B and the respective lateral sides 72, 77, and 79 is constant. Similarly, the medial side 76 of the front midfoot chamber 62 and the medial side 71 of the rear midfoot chamber 60 are equidistant from the medial arm portion 16C as the width W2 of the portion of webbing 16D between the medial arm portion 16C and the respective medial sides 71 and 76 is constant. The width W1 of the webbing 16D along the respective lateral sides 72, 77, and 79 is shown as equal to the width W2 of the webbing 16D along the respective medial sides 71 and 76. The webbing 16D may have the same width W1 between the peripheral chamber 16 and the heel chamber 18 as well. Stated differently, each of the chambers 18, 60, and 62 may be centered between the arms portions 16B and 16C. The widths W1 and W2 can be selected to be sufficiently wide to enable the chambers 18, 60, 62, and 64 to deform outward in the X-Y plane (e.g., in the transverse and longitudinal directions) under loading without interfering with the higher pressure peripheral chamber 16 while still enabling a maximum amount of space in the longitudinal and transverse directions between the lateral arm portion 16B and the medial arm portion 16C to be occupied by the chambers 60, 62, and 64 to enable the chambers 60, 62, and 64 to underlie more of the foot to maximize the cushioning and support benefits provided by the chambers 60, 62, 64.

The bladder 110 includes only a single fill port 82 extending from the front side 75 of the front midfoot chamber 62. The fill port 82 has been sealed in FIG. 12 after inflating the bladder 110, as shown by weld 92, and may be trimmed to a shorter length than shown in FIG. 12. The various chambers of the bladder 110 may be filled to different pressures using only the single fill port 82 due to channels that fluidly connect adjacent chambers, and any or all of the channels may be sealed following inflation to isolate adjacent chambers connected by the channel(s). More specifically, referring to FIG. 13, the bladder 110 includes a first channel 84 extending between and fluidly connecting the forefoot chamber 64 and the front midfoot chamber 62, a second channel 86 extending between and fluidly connecting the front midfoot chamber 62 and the rear midfoot chamber 60, and a third channel 88 extending between and fluidly connecting the rear midfoot chamber 60 and the heel chamber 18. Additionally, a sealed channel 90 (the seal indicated by the weld 92) extends between the front midfoot chamber 62 and the peripheral chamber 16. The channel 90 fluidly connected the front midfoot chamber 62 and the peripheral chamber 16 prior to sealing the channel 90 at the weld 92. In one example, the channels 84, 86, 88, and 90 may be formed by disposing anti-weld material between the polymeric sheets 44, 46 to prevent sealing of the sheets 44, 46 to one another at the channels during thermoforming. One or more of the channels, such as channel 90, may be subsequently sealed by a heat weld 92. In the bladder 110, the channels 84, 86, and 88 are not sealed so that the forefoot chamber 64, the front midfoot chamber 62, and the rear midfoot chamber 60 are in fluid communication with one another as well as with the heel chamber 18, and each of the forefoot chamber 64, the front midfoot chamber 62, the rear midfoot chamber 60, and the heel chamber 18 are fluidly isolated from the peripheral chamber 16.

The peripheral chamber 16 may be inflated to a first fluid pressure that is the relatively highest pressure of the chambers by, for example, initially filling it to a predetermined, relatively high pressure, sealing the channel 90, and filling or releasing fluid from the fill port 82 until a predetermined pressure is achieved in the remaining chambers 18, 60, 62, and 64. In the embodiment shown, the channels 84, 86, and 88 are not sealed, so that the chambers 18, 60, 62, and 64 are at the same second fluid pressure, at least when in a static state. In one non-limiting example, the second fluid pressure in the chambers 18, 60, 62, and 64 may be ambient pressure (if not inflated) or a pressure up to 20 pounds per square inch more than ambient pressure, while the first fluid pressure in the peripheral chamber 16 may be more than 5 pounds per square inch above ambient pressure, up to 30 pounds per square inch above ambient pressure. In a specific example, the peripheral chamber 16 may be inflated to and sealed to retain fluid at 15 pounds per square inch above ambient pressure, and the chambers 18, 60, 62, and 64 may be inflated to and sealed to retain fluid at 5 pounds per square inch above ambient pressure. In another specific example, the peripheral chamber 16 may be inflated to and sealed to retain fluid at 20 pounds per square inch above ambient pressure, and the heel chamber 18 may be inflated to and sealed to retain fluid at 5 pounds per square inch above ambient pressure.

The fluid communication between the chambers 18, 60, 62, and 64 by the unsealed channels 84, 86, and 88 allows the fluid to be displaced from one chamber to the next during dynamic loading. For example, during a forward stride, fluid may be displaced from the heel chamber 18 to the chambers 60, 62, and 64 forward of the heel chamber 18, increasing the pressure in the chambers 60, 62, 64 and providing increased compressive stiffness. In another alternative, any or all of the channels 84, 86, and/or 88 could also be sealed after a predetermined pressure is achieved when inflating the chambers 64, 62, and 60, respectively. The channels 84, 86, and 88 are disposed at the bottom side (e.g., at the ground-facing surface 28) of the bladder 110, and are formed mainly by the second polymeric sheet 46, so that they do not affect the contours of the foot-facing surface 26, are therefore not felt by the wearer, and do not interfere with flexing of the bladder 110 at the webbing 16D between adjacent chambers 60 and 62, and adjacent chambers 62 and 64.

Figure 14:
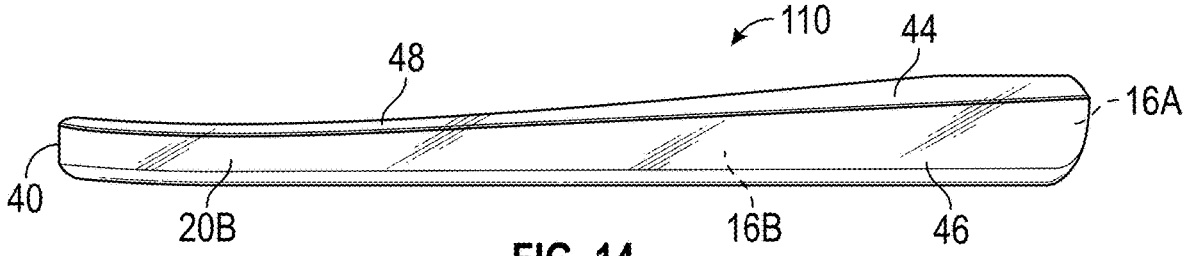
FIG. 14 is a lateral side view of the bladder of FIG. 12.
Figure 15:
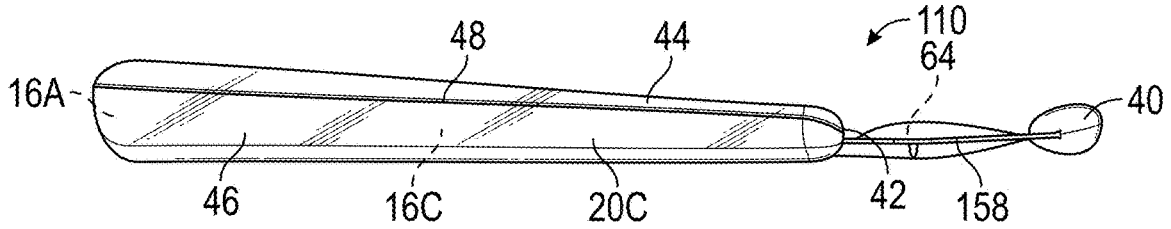
FIG. 15 is a medial side view of the bladder of FIG. 12.
Figure 16:
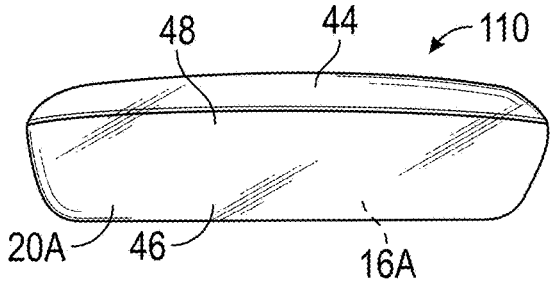
FIG. 16 is a rear view of the bladder of FIG. 12.
Figure 17:
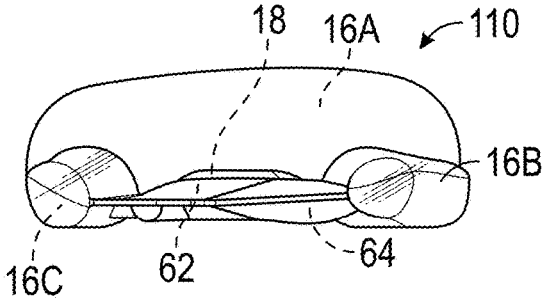
FIG. 17 is a front view of the bladder of FIG. 12.
Figure 18:
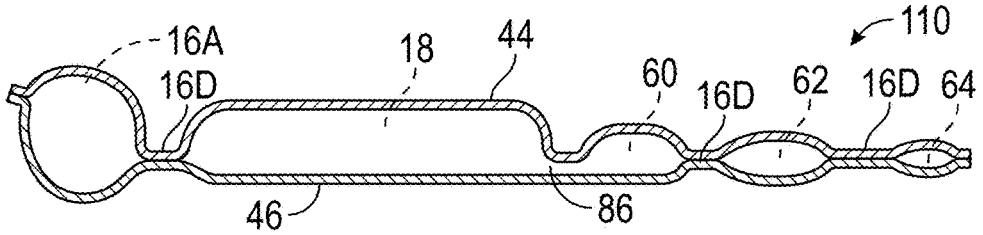
FIG. 18 is a cross-sectional view of the bladder of FIG. 12 taken at lines 18-18 in FIG. 12.
Figure 19:
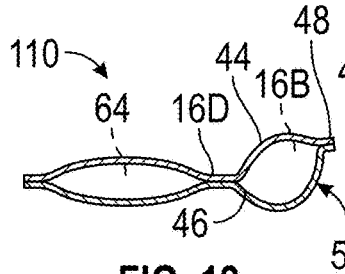
FIG. 19 is a cross-sectional view of the bladder of FIG. 12 taken at lines 19-19 in FIG. 12.
Figure 20:
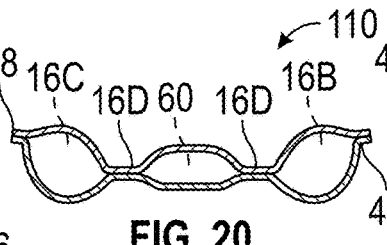
FIG. 20 is a cross-sectional view of the bladder of FIG. 12 taken at lines 20-20 in FIG. 12.
Figure 21:
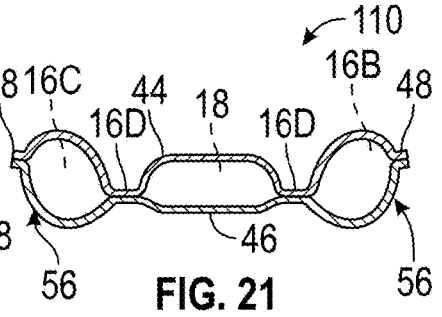
FIG. 21 is a cross-sectional view of the bladder of FIG. 12 taken at lines 21-21 in FIG. 12.

FIG. 14 is a lateral side view of the bladder 110 of FIG. 12 showing the lateral arm portion 16B extending from the heel portion 16A to the terminal end 40. FIG. 15 is a medial side view of the bladder 110, showing the medial arm portion 16C extending from the heel portion 16A to the terminal end 42, which is rearward of the terminal end 40. FIG. 16 is a rear view of the bladder 110 showing the rear of the heel portion 16A. FIG. 17 is a front view of the bladder 110. FIG. 18 is a cross-sectional view of the bladder 110 taken at lines 18-18 in FIG. 12. The cross-section is taken through the unsealed channel 86. FIGS. 19-21 are cross-sectional views of the bladder 110 taken at lines 19-19, 20-20, and 21-21 in FIG. 12, respectively. As with bladder 10, The perimeter flange 48 is higher at the exterior side surface 56 of the bladder 110 than at inner side surfaces of the arm portions 16B, 16C, causing the first polymeric sheet 44 to slope downward and transversely inward as shown to better wrap around and support the periphery of the foot.

The peripheral chamber 16 and the heel chamber 18 of the bladders 10 and 110 are identical. For efficiencies in manufacturing, the bladder 110 may have a groove G1 in the webbing on either the first polymeric sheet 44 or the second polymeric sheet 46 (shown here in the bottom sheet (second polymeric sheet 46)) that serves as a guide at which the bladder 110 may be optionally trimmed to remove the rear midfoot chamber 60, the front midfoot chamber 62, and the forefoot chamber 64 from the bladder 110. The groove G1 may be formed in the bladder 110 during molding, such as during thermoforming. The groove G1 extends between the medial arm portion 16C and the front midfoot chamber 62, between the medial arm portion 16C and the rear midfoot chamber 60, between a rear of the rear midfoot chamber 60 and the heel chamber 18, between rear midfoot chamber 60 and the lateral arm portion 16B, and between the front midfoot chamber 62 and the lateral arm portion 16B. If trimmed at the groove G1, the bladder 110 is transformed into the bladder 10, with the forward edge 58 and the flanges 16E of FIG. 1 defined by and remaining after the trimming. Trimming at the groove G1 may occur any time after forming of the bladder 110. Inflation of the chambers 16, 18 may occur after trimming. Trimming may extend across the channels 90 and 88 shown in FIG. 13, and these may be sealed after inflation, resulting in plugging of the ports 50A, 50B of FIG. 2.

Figure 22:
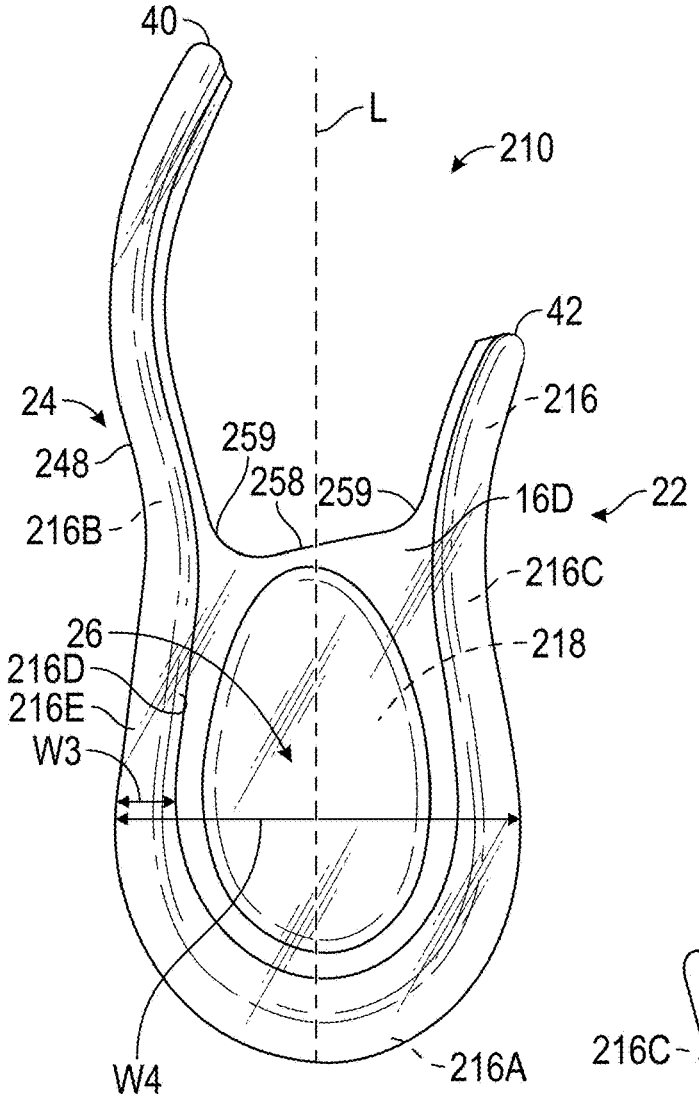
FIG. 22 is a top view of another alternative embodiment of a bladder within the scope of the disclosure.
Figure 23:
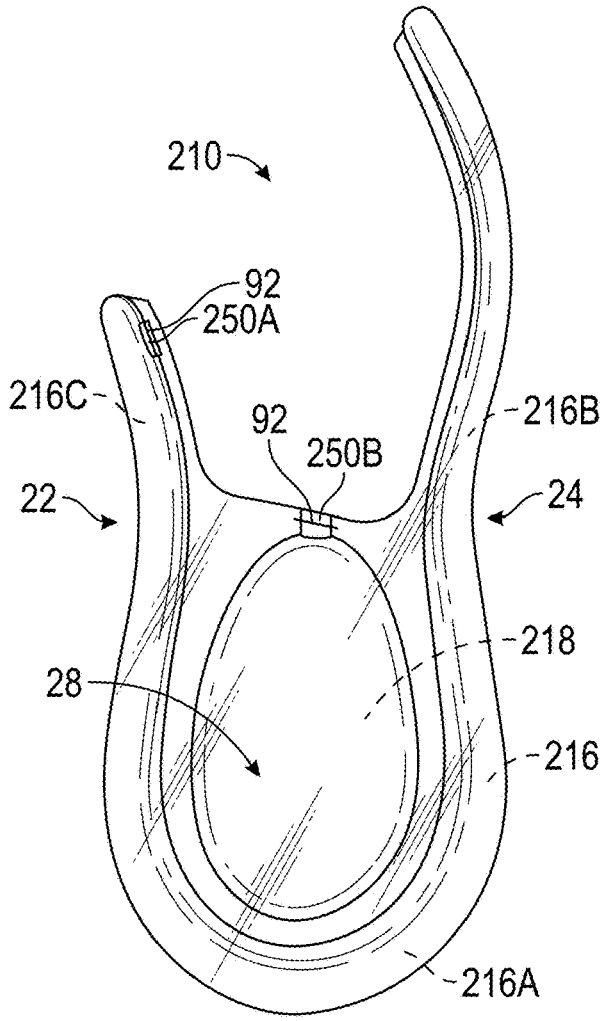
FIG. 23 is a bottom view of the bladder of FIG. 22.

FIGS. 22-23 show top and bottom views, respectively, of another alternative embodiment of a bladder 210. The bladder 210 is alike in many ways to bladders 10 and 110. For example, the bladder 210 has a peripheral chamber 216 and a heel chamber 218 that are fluidly isolated from one another. The heel chamber 218 and the peripheral chamber 216 are the only fluid-filled chambers of the bladder 210. While the bladders 10 and 110 are thermoformed from two polymeric sheets and the various chambers inflated to desired inflation pressures, the bladder 210 is blow molded. In some examples, the chambers 216 and 218 may be pressurized to different internal pressures, with the peripheral chamber 216 at a greater pressure than the heel chamber 218. In other examples, the chambers 216, 218 are not pressurized (e.g., they contain air or another gas at ambient pressure). In the bladder 210 shown herein, the chambers 216, 218 are at ambient pressure and are isolated from one another.

For example, the bladder 210 may be blow molded from a parison of thermoplastic polyurethane material. In blow molding, a molten or otherwise softened elastomeric material, such as thermoplastic polyurethane pellets molten into the shape of a tube (i.e., a parison) is disposed in a mold having the desired overall shape and configuration of the bladder 210. The mold may have multiple components, such as first and second mold halves that come together to form a mold cavity, with an opening at one location through which air is blown to mold the material to the walls of the mold. The air induces the liquefied elastomeric material to conform to the shape of the inner surfaces of the mold, thereby forming the chambers 216, 218, which are then sealed.

Because varying the inflation pressure is not available to affect support and cushioning in an embodiment in which the chambers 216, 218 are unpressurized, the shape, volume, and geometry of the chambers 216, 218 are tuned in order to provide desired support and cushioning. In an unpressurized embodiment, a configuration of the geometry and volume of the heel chamber 218 may lead to resilient deformation during dynamic loading, providing a rebound toward its height and shape prior to the dynamic load. This creates a cushioning effect that is greater than a deformation of a chamber that deforms by simply flattening under a dynamic load with little or no rebound, as can occur in an unpressurized chamber not tuned in geometry and volume for resilient deformation with rebound under a dynamic load. Adjacent components of the sole structure in which a bladder is incorporated also influence the ability of the bladder to resiliently deform with a cushioning rebound. For example, an overlying foam midsole layer and an underlying outsole influence the compression and rebound characteristics of the bladder during dynamic load events.

Accordingly, the unpressurized peripheral chamber 216 and the heel chamber 218 are shaped slightly differently from the corresponding pressurized chambers 16, 18 of the thermoformed bladders 10 and 110. In order to provide sufficient stability given that the bladder 210 is unpressurized, the bladder 210 is lower in profile than the bladders 10 and 110 in that the overall height of the peripheral chamber 216 is less than that of the peripheral chamber 16, and the overall height of the heel chamber 218 is less than that of the heel chamber 18. A lower profile also reduces the overall height of the sole structure that includes the bladder 210 when the heights of an outsole and any overlying midsole layers are added to the height of the bladder 210. A reduction in overall height may be advantageous for stability in footwear configured for toddlers, preschoolers, and older children. Additionally, the shape of the peripheral chamber 216 is different than that of the peripheral chamber 16. The peripheral chamber 216 has an inner wall 216D (i.e., the wall bordering the webbing 16D) that is steeper (i.e., closer to vertical) than the outer wall 216E at least directly outward of the heel chamber 18. This helps to decrease the width of the peripheral chamber 216 relative to a chamber with a more gradual slope at the inner wall 216D. This provides greater stiffness to the peripheral chamber 216, enabling greater peripheral support than would be provided if the peripheral chamber 216 had a more gradually upward and outward sloping surface more symmetrical to that of the outer wall 216E.

The peripheral chamber 216 has a heel portion 216A, a lateral arm portion 216B, and a medial arm portion 216C, arranged as described with respect to the corresponding portions 16A, 16B, and 16C of the peripheral chamber 16 in FIG. 1. The forward edge 258 of the webbing 16D is trimmed with rounded corners 259 rather than the distinct corners shown in FIG. 1.

A perimeter flange formed during molding of the bladder may extend along the outer perimeter of the peripheral chamber at perimeter flange location 248 and may be trimmed away. The perimeter flange location 248 may be relatively high along the outer wall of the peripheral chamber 216, as shown on the like peripheral chamber 216 of the bladder 310 in FIG. 26, or the perimeter flange location 248 may be relatively low, as described herein with respect to perimeter flange location 448 of the bladder 410 of FIGS. 27-37.

The peripheral chamber 216 is relatively more narrow than the peripheral chamber 16 and the heel chamber 218 is relatively wider and of greater volume than the heel chamber 18. A ratio of the overall width W3 of any portion of the peripheral chamber 216 to a width W4 of the bladder 210 at a cross-section taken perpendicular to the longitudinal midline L of the bladder 210 is less than a ratio of the width W5 of a corresponding portion of the peripheral chamber 16 of the bladder 10 or 110 to a width W6 of the bladder 10 or 110. By making the unpressurized peripheral chamber 216 relatively narrow, it will tend to collapse under loading less than would a wider unpressurized peripheral chamber, thereby providing greater peripheral support. Additionally, because the peripheral chamber 216 is relatively narrow, there is sufficient space between the arm portions 216B, 216C (assuming a given overall width W4) to make the heel chamber 218 wider and less elongated than the heel chamber 18. This enables the heel chamber 218 to have a greater volume than if the peripheral chamber 216 were wider, while still having a lower profile than the peripheral chamber 216 so that loading of the heel chamber 218 is secondary to loading of the peripheral chamber 216. The greater volume, wider heel chamber 218 is able to resiliently deform (e.g., rebound under dynamic loading) and provide cushioning despite it being unpressurized. Referring to FIG. 23, there are separate sealed fill ports 250A, 250B for the peripheral chamber 216 and the heel chamber 218, similar to fill ports 50A, 50B. The peripheral chamber 216 and the heel chamber 218 are fluidly isolated from one another. In a pressurized embodiment, the chambers 216, 218 may have different fluid pressures. In one example, the peripheral chamber 216 is inflated to and retains fluid at a first fluid pressure, and the heel chamber 218 is inflated to and retains fluid at a second fluid pressure less than the first fluid pressure.

Figure 24:
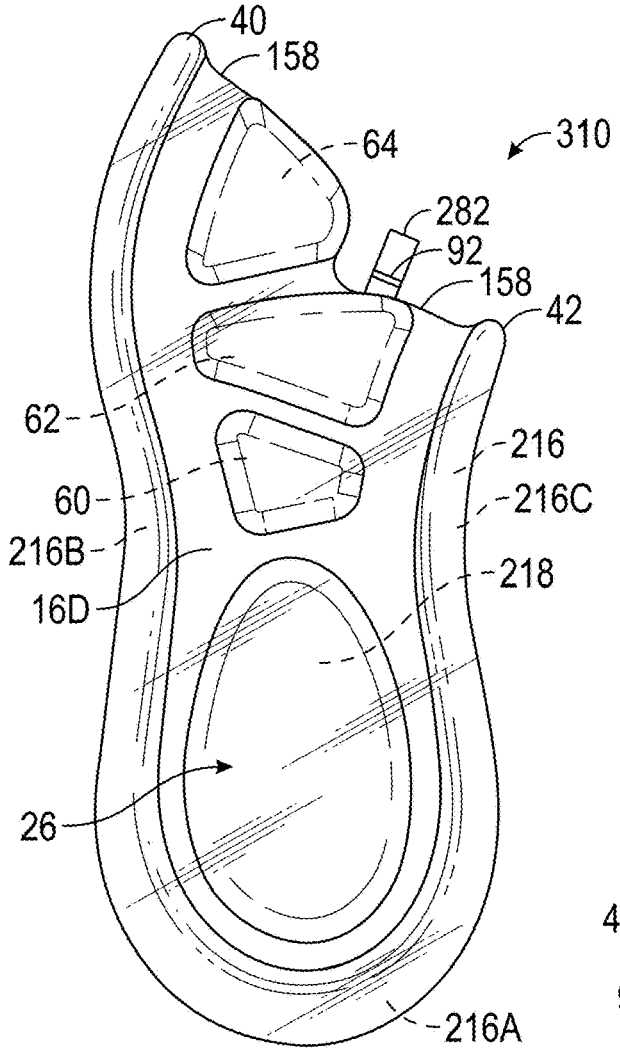
FIG. 24 is a top view of another alternative embodiment of a bladder within the scope of the disclosure.
Figure 25:
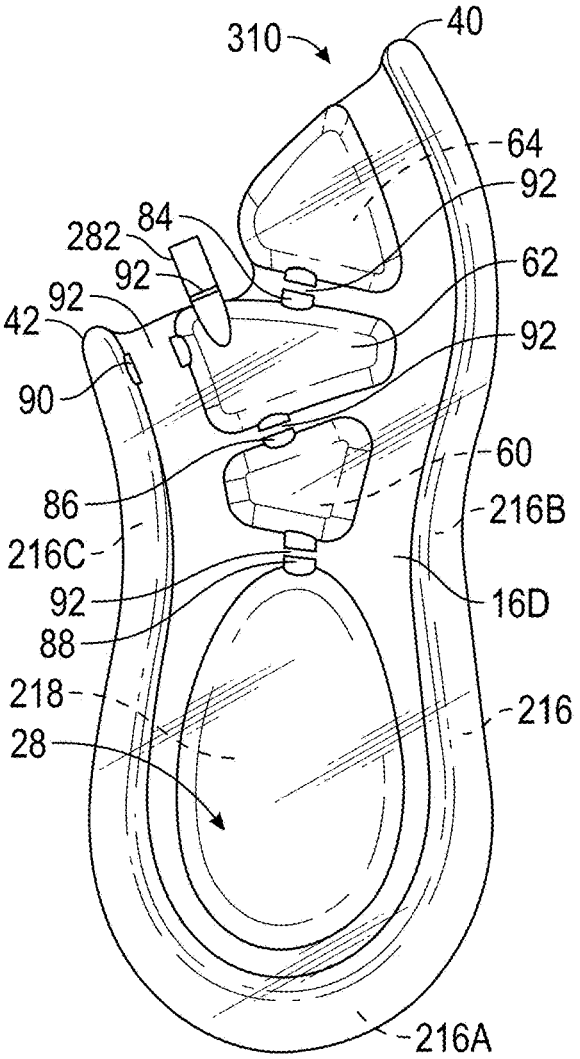
FIG. 25 is a bottom view of the bladder of FIG. 24.
Figure 26:
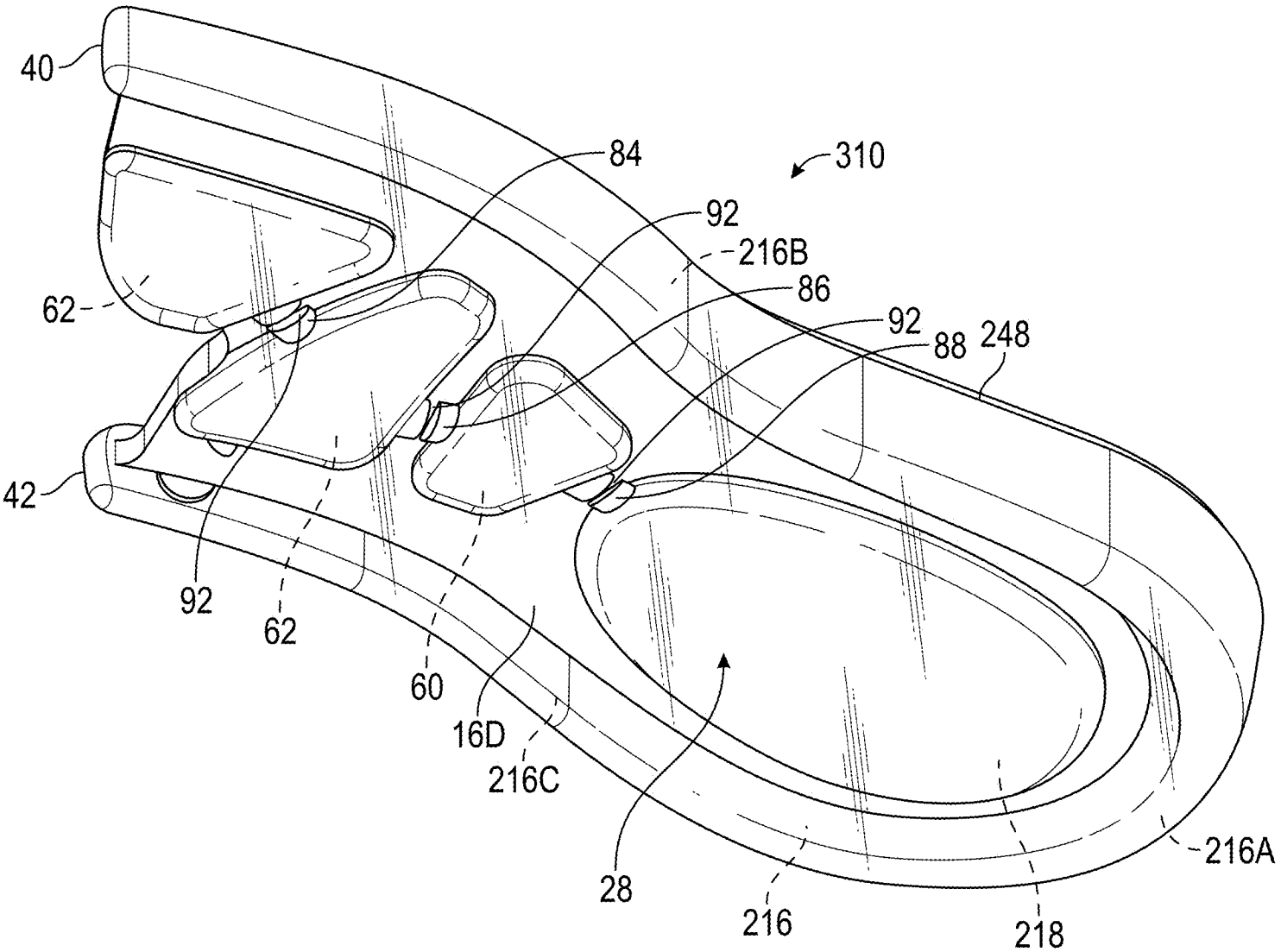
FIG. 26 is a bottom perspective view of the bladder of FIG. 24.

FIGS. 24-26 show another alternative embodiment of a bladder 310. The bladder 310 is alike in many ways to bladder 110 except that it includes the slightly different peripheral chamber 216 and heel chamber 218 as described with respect to bladder 210, a single fill port 282, similar to fill port 82, and in addition to sealed channel 90 fluidly isolating the peripheral chamber 216 from all other chambers, each of the channels 84, 86, and 88 are sealed so that each of the forefoot chamber 64, the front midfoot chamber 62, and the rear midfoot chamber 60 are fluidly isolated from one another and from the heel chamber 218. The peripheral chamber 216, the heel chamber 218, the rear midfoot chamber 60, the front midfoot chamber 62, and the forefoot chamber 64 are the only fluid-filled chambers of the bladder 310. In a pressurized version, this configuration allows up to five different fluid pressures in the five fluidly-isolated chambers 216, 218, 60, 62, and 64. Alternatively, channel 84 could be left unsealed so that chambers 62 and 64 are in fluid communication, or channel 86 could be left unsealed so that chambers 62 and 60 are in fluid communication, or channel 88 could be left unsealed so that chambers 60 and 218 are in fluid communication, or any combination of two of the three channels 84, 86, and 88 could be left unsealed. If one or more of the adjacent chambers 60, 62, and 64 are in fluid communication with one another, even in an unpressurized version, air would be pushed from a more rearward chamber to a more forward chamber with which it is in communication during a forward foot roll, increasing the pressure in the more forward chamber to provide support for toe off. In an unpressurized version, all of the chambers 216, 218, 60, 62, and 64 would be at atmospheric pressure when in the static state.

Figure 27:
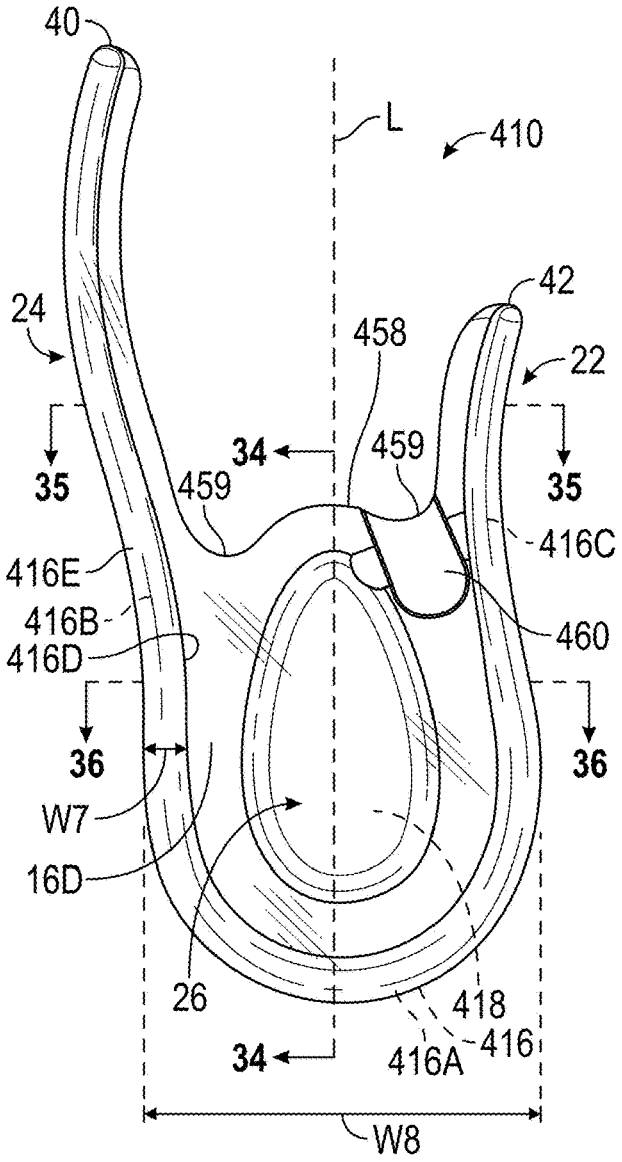
FIG. 27 is a top view of an alternative embodiment of a bladder within the scope of the disclosure.
Figure 28:
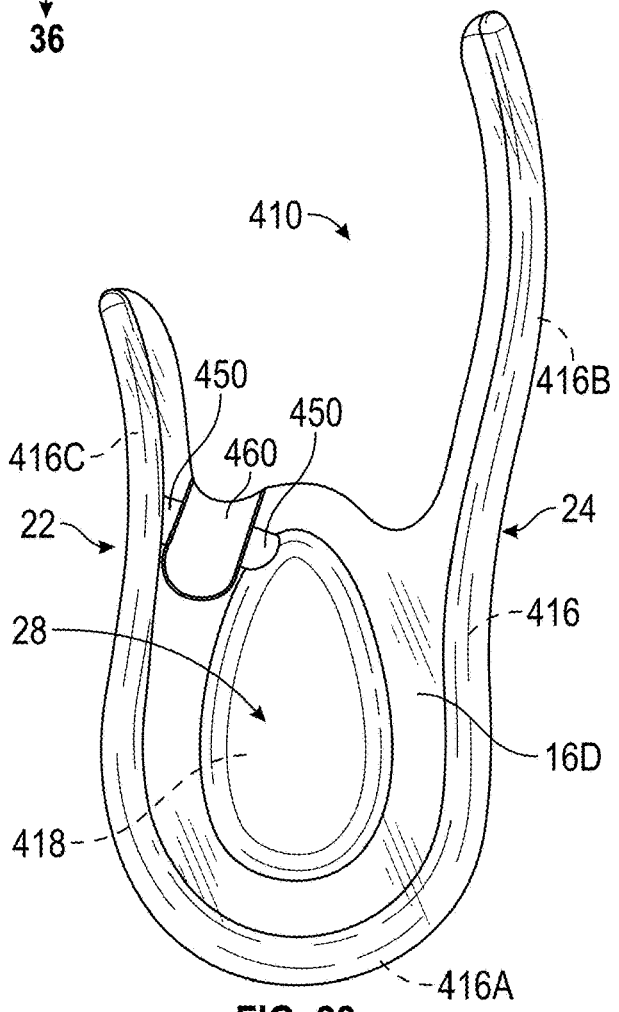
FIG. 28 is a bottom view of the bladder of FIG. 27.

FIG. 27 is a top view of an alternative embodiment of a bladder 410 within the scope of the disclosure. FIG. 28 is a bottom view of the bladder of FIG. 27. The bladder 410 is alike in many ways to the bladder 310, and includes a peripheral chamber 416 and a heel chamber 418. The heel chamber 418 and the peripheral chamber 416 are the only fluid-filled chambers of the bladder 410. The bladder 410 is blow molded, and the peripheral chamber 416 and the heel chamber 418 are unpressurized and isolated from one another. Stated differently, the chambers 416, 418 are at ambient pressure and are isolated from one another.

The peripheral chamber 416 includes a medial arm portion 416C, a lateral arm portion 416B, and a heel portion 416A from which the medial arm portion 416C and lateral arm portion 416B extend, and these portions 416A, 416B, and 416C arranged as described with respect to the corresponding portions 16A, 16B, and 16C of the peripheral chamber 16 in FIG. 1. Webbing 16D connects the peripheral chamber 416 to the heel chamber 418.

Figure 35:
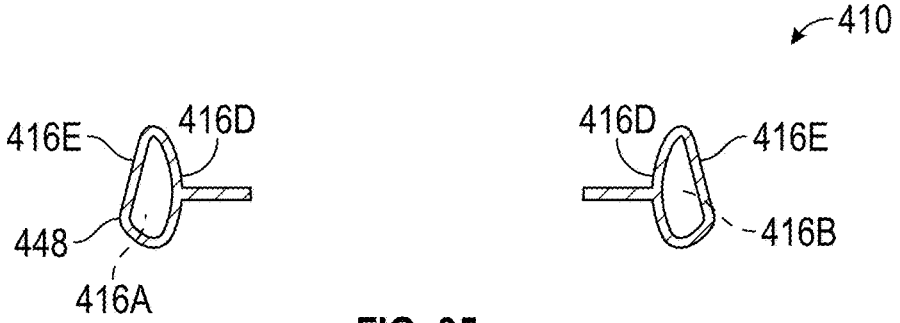
FIG. 35 is a cross-sectional view of the bladder of FIG. 27 taken at lines 35-35 in FIG. 27.
Figure 36:
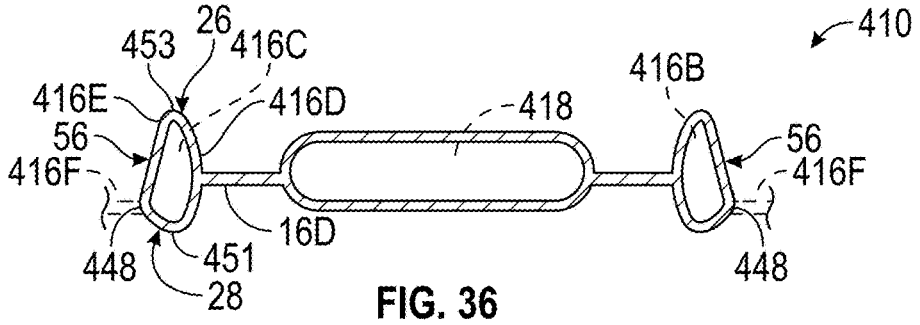
FIG. 36 is a cross-sectional view of the bladder of FIG. 27 taken at lines 36-36 in FIG. 27.

The bladder 410 includes a single channel 450 through which air is blown during the blow molding process to form the chambers 416, 418. The channel 450 is sealed shut at weld 460 (by the mold portions of the blow mold or after removal from the mold) to isolate the chambers 416, 418 from one another after the blown air forms the bladder 410 with the chambers 416, 418. Like bladder 210, the unpressurized chambers 416, 418 are tuned in order to provide desired support and cushioning. In order to provide sufficient stability given that the bladder 410 is unpressurized, the bladder 410 is lower in profile than the bladders 10 and 110 in that the overall height of the peripheral chamber 416 is less than that of the peripheral chamber 16, and the overall height of the heel chamber 418 is less than that of the heel chamber 18. Additionally, the shape of the peripheral chamber 416 is different than that of the peripheral chamber 16. The peripheral chamber 416 has an inner wall 416D (i.e., the wall bordering the webbing 16D) that is steeper (i.e., closer to vertical) than the outer wall 416E, as best shown in FIGS. 35 and 36. This helps to decrease the width of the peripheral chamber 416 relative to a chamber with a more gradual slope at the inner wall 416D. This provides greater stiffness to the peripheral chamber 416, enabling greater peripheral support, than would be provided if the inner wall 416D had a more gradually upward and outward sloping surface more symmetrical to that of the outer wall 416E.

The peripheral chamber 416 is relatively more narrow than the peripheral chamber 16 and the heel chamber 418 may be relatively wider and of greater volume than the heel chamber 18. The peripheral chamber 416 is even relatively more narrow than peripheral chamber 216, and the heel chamber 418 is narrower than heel chamber 218. A ratio of the width W7 of any portion of the peripheral chamber 416 to the overall width W8 of the bladder 410 at a cross-section taken perpendicular to the longitudinal midline L of the bladder 410 is less than a ratio of the width W5 of a corresponding portion of the peripheral chamber 16 of the bladder 10 or 210 to an overall width W6 of the bladder 10 or 210 at a corresponding cross-section. By configuring the unpressurized peripheral chamber 416 to be relatively narrow, it will tend to collapse under loading less than would a wider unpressurized peripheral chamber, thereby providing greater peripheral support. Additionally, because the peripheral chamber 416 is relatively narrow, there is sufficient space between the arm portions 416B, 416C (assuming a given overall width W8) to make the heel chamber 418 wider and less elongated than the heel chamber 18. This enables the heel chamber 418 to have a greater volume than if the peripheral chamber 416 were wider, while still having a lower profile than the peripheral chamber 416 so that loading of the heel chamber 418 is secondary to loading of the peripheral chamber 416. The greater volume, wider heel chamber 418 is able to resiliently deform (e.g., rebound under dynamic loading) and provide cushioning despite it being unpressurized. Additionally, the relatively narrow peripheral chamber 416 provides for a wider webbing 16D surrounding the heel chamber 418, giving the heel chamber 418 more space to deform outward during dynamic loading without interference from the peripheral chamber 416. The forward edge 458 of the webbing 16D is trimmed with rounded corners 459 rather than the distinct corners shown in FIG. 1.

Trimming of the bladder 410 at the forward edge 458 and at a perimeter flange 416F (shown in phantom in FIG. 36) at perimeter flange location 448 (trimmed away in FIGS. 27-36) may occur with the bladder 410 in the blow molding machine. The molds may form multiple bladders 410 at once, with the molten polymeric material extending between adjacent bladders trimmed away by the blow molding machine when molding is complete. For example, interfacing mold portions may have edges that align at the perimeter flange location 448 to trim away the flange 416F. In the figures shown, the trimmed material is trimmed so closely at the perimeter flange location 448 that the flange 416F is not visible. The molds are configured so that the flange 416F and the perimeter flange location 448 along the exterior side surface 56 is closer to a lowest extremity 451 of the peripheral chamber 416 at the ground-facing surface 28 than to a highest extremity 453 of the peripheral chamber 416 at the foot-facing surface 26. This positioning of the flange 416F and the perimeter flange location 448 is at least in the heel region 34 along the lateral periphery 20B, the rear periphery 20A, and the medial periphery 20C, and, as shown, preferably also in the forefoot region 30 and the midfoot region 32. FIG. 30 best shows the relatively low position of the perimeter flange location 448 in comparison to the location of the flange 48 on the exterior side surface 56 of the bladder 10 in FIG. 3. This lower position results in the bladder 410 being wider at the ground-facing surface 28 than at the foot-facing surface 26 than it would be if the flange 416F and perimeter flange location 448 were higher, like the flange 48 in FIG. 11.

As can be seen in FIG. 36, most of the exterior side surface 56 flares outward from top to bottom, whereas in FIG. 11, most of the exterior side surface 56 flares inward. A bladder that is wider in the transverse direction toward the bottom than toward the top, as is the bladder 410 due to the placement of perimeter flange location 448, provides greater stability than a narrower bladder of the same length. When assembled with other components of an article of footwear, an outsole, such as outsole 54 of FIG. 3 would extend to the perimeter flange location 448 and would end at the perimeter flange location 448 without wrapping further up the exterior side surface 56. This configuration also maximizes the visible exterior side surface 56 while at the same time generally not exposing the perimeter flange location 448 because it would extend just along the outsole 54. Stated differently, the outsole 54 would extend to the peripheral flange location 448. In some embodiments, the outsole 54 may terminate at the peripheral flange location 448 so that an upper edge of the outsole is coincident with the peripheral flange location 448. In other embodiments, the outsole 54 may extend upward beyond the peripheral flange location 448 to cover the peripheral flange location 448.

Although any of the bladders shown and described herein may be scaled to foot sizes from infant to adult, the bladder 410 may be especially suitable for a toddler, as a toddler foot is, on average, wider and shorter than the foot of a preschooler and the foot of a grade schooler. A last on which a footwear upper is placed and a sole structure is secured will be wider and shorter when configured for a footwear size generally worn by toddlers than a last configured for a footwear size generally worn by preschoolers, and the last configured for the footwear size generally worn by preschoolers will be shorter and possibly wider than a last configured for a footwear size generally worn by grade schoolers. The wider bladder 410 with the perimeter flange location 448 and the relatively wide width toward the bottom at the perimeter flange location 448 is thus especially suitable for a toddler.

Figure 29:
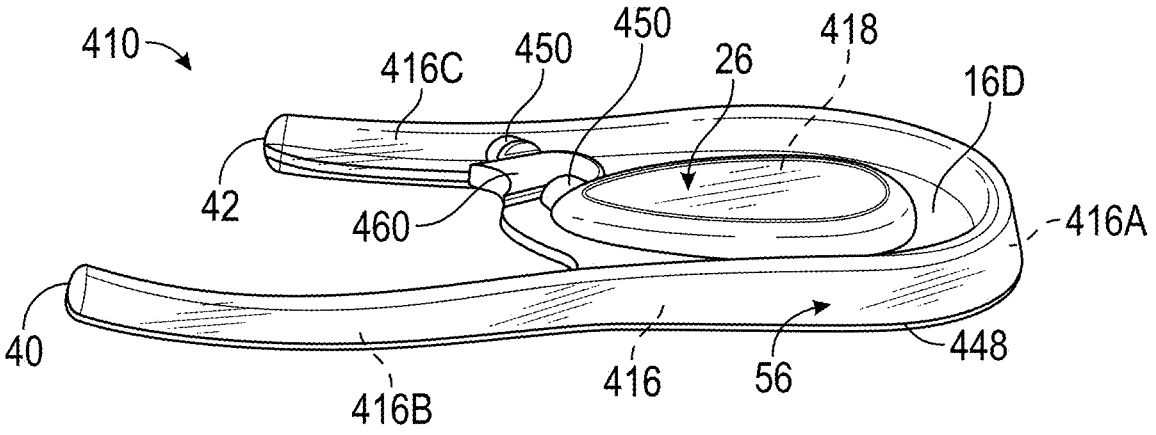
FIG. 29 is a perspective view of the bladder of FIG. 27.
Figure 30:
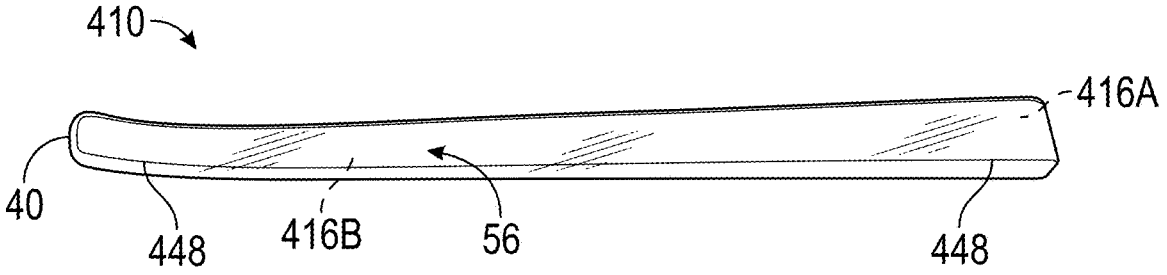
FIG. 30 is a lateral side view of the bladder of FIG. 27.
Figure 31:
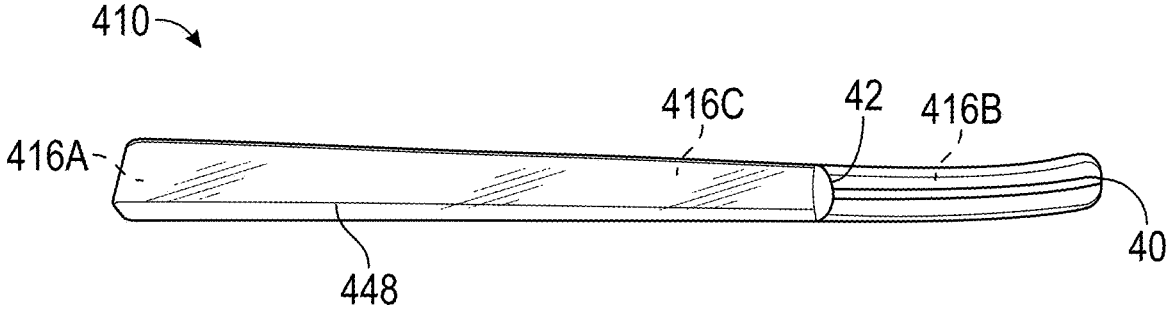
FIG. 31 is a medial side view of the bladder of FIG. 27.
Figure 32:
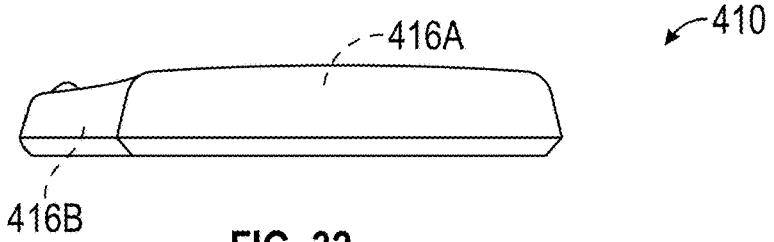
FIG. 32 is a rear view of the bladder of FIG. 27.
Figure 33:
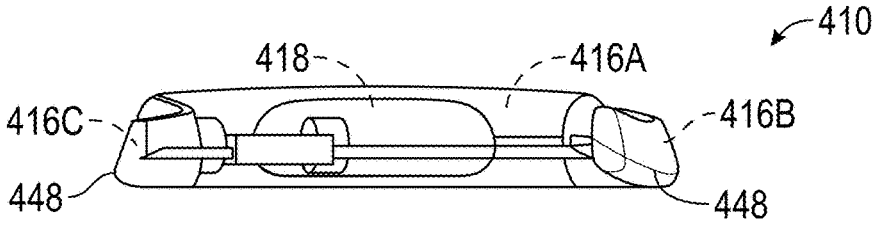
FIG. 33 is a front view of the bladder of FIG. 27.
Figure 34:
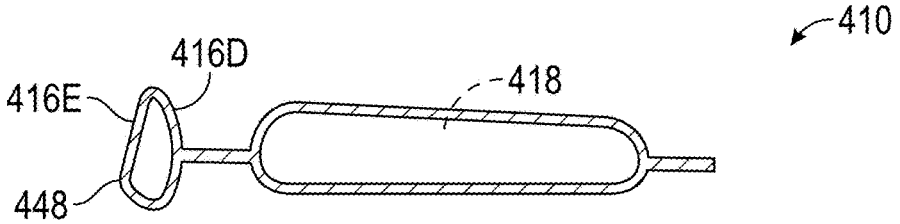
FIG. 34 is a cross-sectional view of the bladder of FIG. 27 taken at lines 34-34 in FIG. 27.

FIGS. 29, 30, and 31 show that the lateral arm portion 416B and the medial arm portion 416C of the peripheral chamber 416 taper in height from the heel portion 416A to the respective terminal ends 40, 42, and that the peripheral chamber 416 is greatest in height at the heel portion 416A. FIG. 32 is a rear view of the bladder 410. FIG. 33 is a front view of the bladder 410 and shows both the arm portions 416B, 416C, and heel portion 416A of the peripheral chamber 416 and also shows the heel chamber 418. FIG. 34 is a cross-sectional view of the bladder 410 taken at lines 34-34 in FIG. 27. It is evident from FIGS. 32 and 33 that the elevation of the heel chamber 418 is less than the elevation of the heel portion 416A of the peripheral chamber 416. Due to this height differential, as well as the tapering height of the peripheral chamber 416 from the heel portion 416A to the terminal ends 40, 42, during wear, an article of footwear that includes the bladder 410 (such as article of footwear 14 if the bladder 410 were used instead of bladder 10) will typically first make contact with the ground at the heel region 34, and the much taller peripheral chamber 416 will be loaded before the heel chamber 418. In an embodiment in which the heel chamber 418 is unpressurized, due to its volume, height, and width, as well as the spacing from the arm portions 416B, 416C, it may resiliently deform under dynamic loading, providing cushioning under the calcaneus bone.

Figure 38:
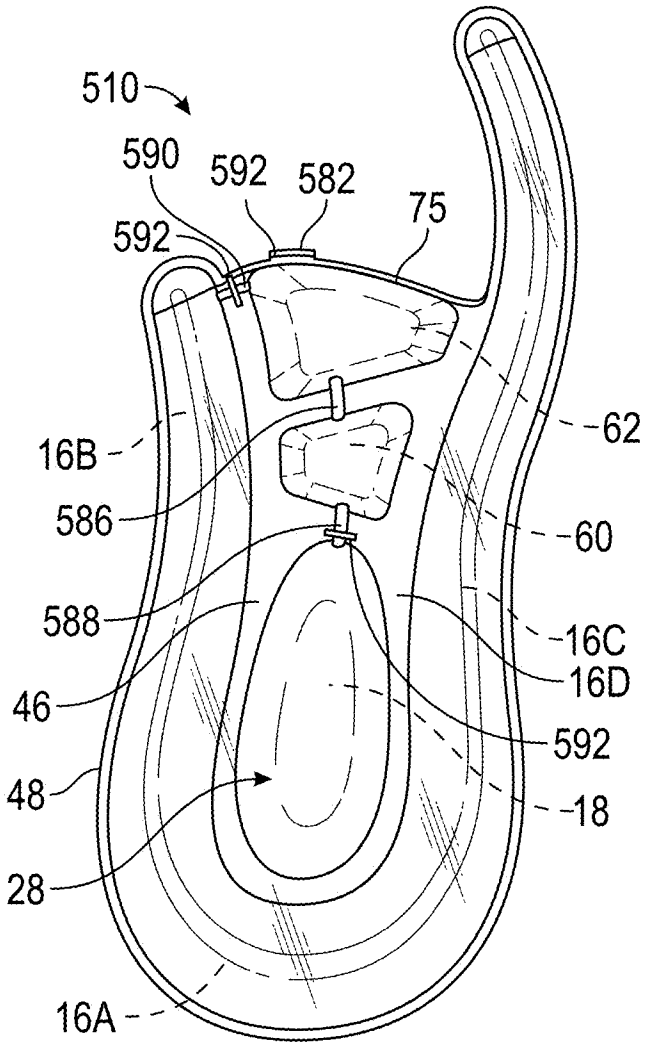
FIG. 38 is a bottom view of the bladder of FIG. 37.
Figure 37:
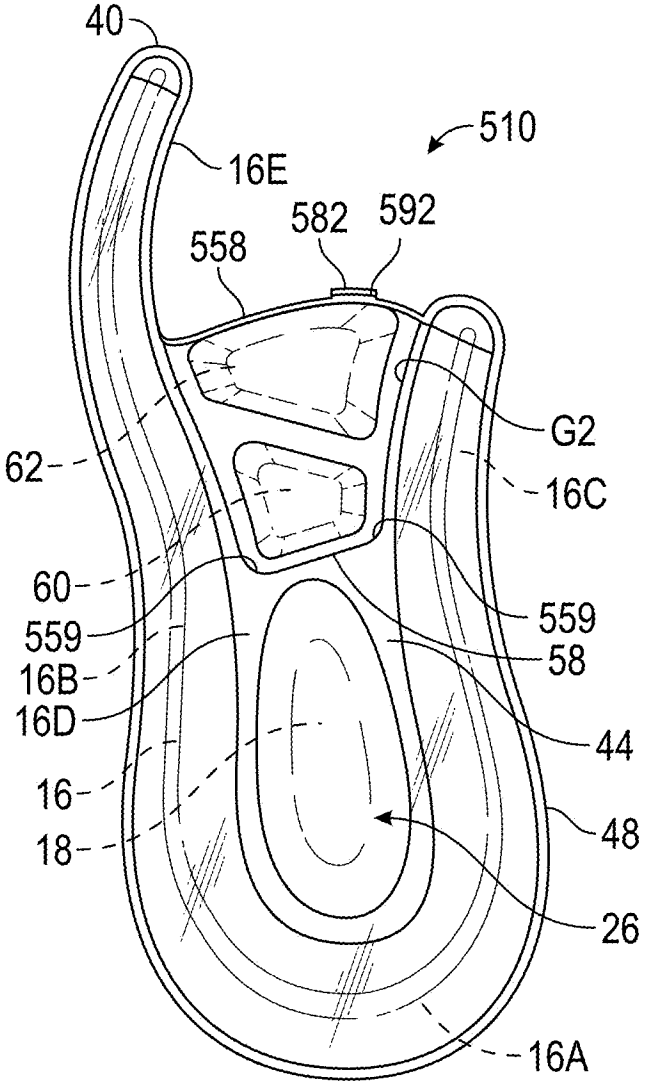
FIG. 37 is a top view of another alternative embodiment of a bladder within the scope of the disclosure.

FIG. 37 is a top view of another alternative embodiment of a bladder 510 within the scope of the disclosure. FIG. 38 is a bottom view of the bladder 510 of FIG. 37. The bladder 510 has many of the same features and components of the bladder 110 of FIG. 12, and like reference numbers are used to identify those features and components. The bladder 510 is thermoformed from a first polymeric sheet 44 and a second polymeric sheet 46 as described with respect to bladder 110. The bladder does not include the forefoot chamber 64, but does include the rear midfoot chamber 60 and the front midfoot chamber 62. The heel chamber 18, the peripheral chamber 16, the rear midfoot chamber 60, and the front midfoot chamber 62 are the only fluid-filled chambers of the bladder 510.

For efficiencies in manufacturing, the bladder 510 may have a groove G2 in the webbing 16D on either the first polymeric sheet 44 or the second polymeric sheet 46 (shown here in the top sheet (first polymeric sheet 44)) that will serve as a guide at which the bladder 510 may be optionally trimmed. The groove G2 may be formed in the bladder 510 during molding, such as during thermoforming. The groove G2 extends between the medial arm portion 16C and the front midfoot chamber 62, between the medial arm portion 16C and the rear midfoot chamber 60, between a rear of the rear midfoot chamber and the heel chamber 18, between the rear midfoot chamber 60 and the lateral arm portion 16B, and between the front midfoot chamber 62 and the lateral arm portion 16B. The bladder 510 may be trimmed at the portions of the webbing 16D extending along the inner side of the arm portion 16B and at the forward edge 558, so that only a flange 16E remains at these portions. If trimmed at the groove G2, the rear midfoot chamber 60 and the front midfoot chamber 62 are removed from the bladder 510, and the bladder 510 is transformed into a bladder like the bladder 10, with the forward edge 58 and the flanges 16E of FIG. 1 defined by and remaining after the trimming, except with more rounded corners at corners 559. Trimming may occur any time after forming of the bladder 510. Inflation of the chambers 16, 18 may occur after trimming. The bladder 510 may be trimmed across the port 582, which may be sealed by weld 592 after inflation. If trimmed at the groove G2, the trimming extends across the channel 588, which may be sealed by weld 592 after inflation of the heel chamber 18.

The bladder 510 includes only a single fill port 582 extending from the front side 75 of the front midfoot chamber 62. The fill port 582 is sealed in FIG. 38 as shown by weld 592. The various chambers of the bladder 510 may be filled to different pressures using only the single fill port 582 due to channels that fluidly connect adjacent chambers, and any or all of the channels may be sealed following inflation to isolate the chambers connected by the channel(s). More specifically, referring to FIG. 38, the bladder 510 includes a channel 586 extending between and fluidly connecting the front midfoot chamber 62 and the rear midfoot chamber 60, and a channel 588 extending between and fluidly connecting the rear midfoot chamber 60 and the heel chamber 18. Channel 586 is the only channel extending between the front midfoot chamber 62 and the rear midfoot chamber 60. Channel 588 is the only channel extending between the rear midfoot chamber 60 and the heel chamber 18. Additionally, a channel 590 extends between the front midfoot chamber 62 and the peripheral chamber 16. Channel 590 is the only channel extending from the peripheral chamber 16. In one example, the channels 586, 588, and 590 may be formed by disposing anti-weld material between the polymeric sheets 44, 46 to prevent sealing of the sheets 44, 46 to one another at the channels. One or more of the channels, such as channel 590, may be subsequently sealed by a heat weld 592. The channel 590 fluidly connects the front midfoot chamber 62 and the peripheral chamber 16 prior to sealing the channel 590 at the weld 592, and the front midfoot chamber 62 and the peripheral chamber 16 are fluidly isolated from one another once the channel 590 is sealed. In the embodiment shown, the channel 586 is not sealed so that the front midfoot chamber 62 and the rear midfoot chamber 60 are in fluid communication with one another via the channel 586. In the embodiment shown, channel 588 is sealed by a heat weld 592. The channel 588 fluidly connects the rear midfoot chamber 60 and the heel chamber 18 prior to sealing the channel 588 at the weld 592. The rear midfoot chamber 60 and the heel chamber 18 are fluidly isolated from one another once the channel 588 is sealed. The heel chamber 18 and each of the front midfoot chamber 62 and the rear midfoot chamber 60 are fluidly isolated from the peripheral chamber 16.

The peripheral chamber 16 may be inflated to a first fluid pressure that is the relatively highest pressure of the chambers by, for example, initially filling it to a predetermined, relatively high pressure, sealing the channel 590 via the weld 592, filling or releasing fluid from the fill port 82 until a predetermined pressure is achieved in the heel chamber 18, sealing the channel 588 via the weld 592, and filling or releasing fluid from the fill port 82 until a predetermined pressure is achieved in the fluidly connected rear midfoot chamber 60 and front midfoot chamber 62, and then sealing the port 582 via a weld 592. In the embodiment shown, the channel 586 is not sealed, so that the chambers 60 and 62 are at the same fluid pressure, at least when in a static state.

In one non-limiting example, the first fluid pressure in the peripheral chamber 16 may be more than 5 pounds per square inch above ambient pressure, up to 30 pounds per square inch above ambient pressure. The second fluid pressure in the heel chamber 18, may be ambient pressure or a pressure up to 20 pounds per square inch more than ambient pressure, and the fluid pressure in the chambers 60, 62 may be the same or different than that in the heel chamber 18 and may be ambient pressure or a pressure up to 20 pounds per square inch more than ambient pressure. In a specific example, the peripheral chamber 16 may be inflated to and sealed to retain fluid at 15 pounds per square inch above ambient pressure, and the chambers 18, 60, and 62 may be inflated to and sealed to retain fluid at 5 pounds per square inch above ambient pressure. The fluid communication between the chambers 60 and 62 allows the fluid to be displaced from one chamber to the next during dynamic loading. For example, during a forward stride, fluid may be displaced from the rear midfoot chamber 60 to the front midfoot chamber 62, increasing the pressure in the chamber 62 during dynamic loading and providing increased compressive stiffness. Sealing the heel chamber 18 from the other chambers may further enable it to provide resilient deformation during dynamic loading even at the relatively low inflation pressure of 5 pounds per square inch above ambient pressure. In other alternatives, the channel 586 could be sealed instead of the channel 588, or both of the channels 586 and 588 could be sealed, or neither of the channels 588 and 586 may be sealed. The port 582 and channels 590, 586, and 588 are disposed at the bottom side (e.g., at the ground-facing surface 28) of the bladder 510, and are formed mainly by the second polymeric sheet 46, so that they do not affect the contours of the foot-facing surface 26, are therefore not felt by the wearer, and do not interfere with flexing of the bladder 510 at the webbing 16D between adjacent chambers 60 and 62.

In still another embodiment, instead of thermoforming the bladder 510 without a forefoot chamber 64 as shown, the bladder 510 could instead initially be thermoformed with a forefoot chamber 64 and then trimmed along the webbing 16D between forefoot chamber 64 and front midfoot chamber 62 before sealing port 82. A groove could be provided around the forefoot chamber 64 to facilitate such trimming, such as described with respect to groove G2 except the groove would only extend around the forefoot chamber 64.

Figure 39:
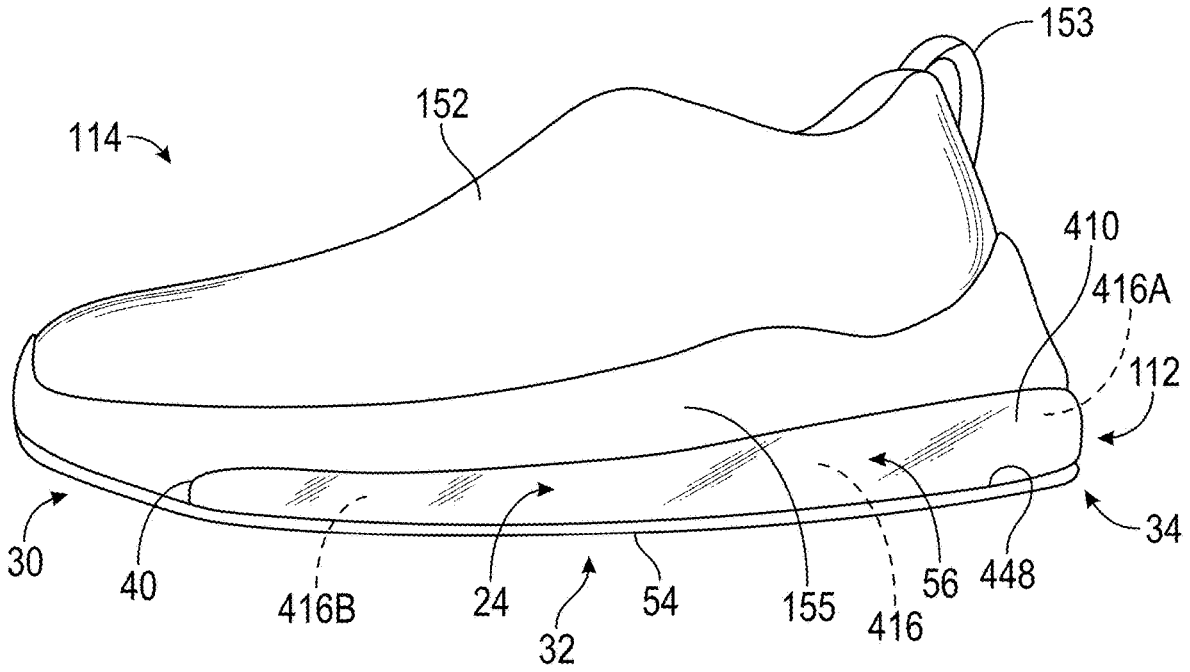
FIG. 39 is a lateral side view of an article of footwear including a sole structure with the bladder of FIG. 27.
Figure 40:
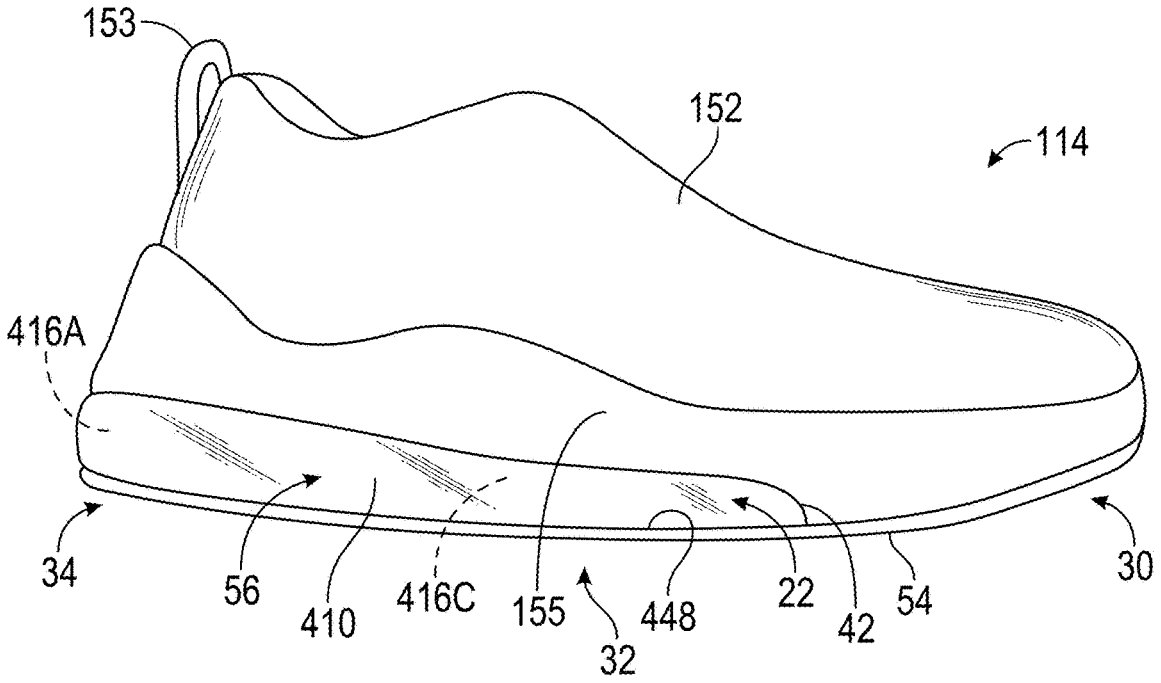
FIG. 40 is a medial side view of the article of footwear of FIG. 39.

FIG. 39 is a lateral side view of an article of footwear 114 including an upper 152 and a sole structure 112. The sole structure 112 includes a cushioning element which, in the embodiment shown is the bladder 410 of FIG. 27, the outsole 54, and a midsole layer 155 as described herein. Although shown as the bladder 410, the cushioning element could instead be a foam material or another resiliently deformable material that provides cushioning, instead of a bladder with a fluid-filled peripheral chamber. FIG. 40 is a medial side view of the article of footwear 114 of FIG. 39. The article of footwear 114 includes an upper 152 that is a slip-on upper, shown without laces, and with a heel pull 153 secured at the heel region 34 for ease in pulling the article of footwear 114 onto a foot. Other alternative upper configurations could instead be used with the sole structure 112. The upper 152 is secured to and overlays the midsole layer 155. The midsole layer 155 is between the upper 152 and the bladder 410.

As previously discussed with respect to the bladder 410, the lateral arm portion 416B extends further into the forefoot region 30 than the medial arm portion 416C, as the terminal end 40 is further forward than the terminal end 42. The exterior side surface 56 of the bladder 410 is visible at the lateral side 24 along the lateral arm portion 416B from the terminal end 40 to the heel portion 16A. The exterior side surface 56 of the bladder 410 is also visible at the medial side 22 along the medial arm portion 416C from the terminal end 42 to the heel portion 416A. In some examples, as shown with respect to bladder 410, the entire exterior surface 56 of the bladder 410 may be exposed between the midsole layer 155 and the outsole 54 at the medial arm portion 416C, the lateral arm portion 416B, and the heel portion 416A.

The midsole layer 155 may be, for example, a foam material and can have a different compressive stiffness than the compressive stiffnesses of the peripheral chamber 416 and a different compressive stiffness than the heel chamber 418 (not visible in the side views of FIGS. 39 and 40, but shown in FIGS. 27 and 28, for example). The midsole layer 155 is a full length midsole layer, and is disposed in the forefoot region 30, the midfoot region 32 and the heel region 34. The midsole layer 155 extends from the front of the forefoot region 30 to the rear of the heel region 34. The midsole layer 155 extends over the outsole 54 in the forefoot region 30, over the top surface and the surface of the inner wall 416D of the lateral and medial arm portions 416B, 416C, and the top surface and surface of the inner wall of the heel portion 416A, over the webbing 16D and over the heel chamber 418, without covering the exterior side surface 56 of the bladder 410. Stated differently, the midsole layer 155 leaves the exterior side surface 56 exposed so that the exterior side surface 56 of the bladder 410 is visible at the lateral side 24 of the footwear 114, as shown in FIG. 39, at the medial side 22 as shown in FIG. 40, and at the rear of the heel region 34 as is evident in both views. This visibility is possible because the midsole layer 155 and the outsole 54 are arranged so that the exterior side surface 56 of the bladder 410 is exposed between the midsole layer 155 and the outsole 54 at the medial arm portion 416C, the lateral arm portion 416B, and the heel portion 416A. The outsole 54 is shown extending to the perimeter flange location 448. For example, the upper edge of the outsole 54 is shown terminating at the perimeter flange location 448 so that the outsole 54 is coincident with the perimeter flange location 448. In such an embodiment, the perimeter flange disposed at the perimeter flange location 448 is not readily apparent on the exterior side surface 56. In other embodiments, the outsole 54 may extend upward over the perimeter flange location 448 to cover the perimeter flange and the perimeter flange location 448.

The midsole layer 155 fills the recessed space shown in FIG. 29 between the heel chamber 418 and the peripheral chamber 416 on the webbing 16D and overlays the heel chamber 418. By filling the recessed space, the midsole layer 155 provides some support at the inner wall 416D to help limit an inward collapse of the peripheral chamber 416 under dynamic loading.

For bladders disclosed herein that are molded by thermoforming, such as bladders 10, 110, and 510, a method of manufacturing footwear may include any or all of the steps of the method 600 set forth in Table 1 below, as discussed herein.

TABLE 1

| 600-Method of Manufacturing Footwear | |
|---|---|
| 602 | Mold polymeric material by thermoforming to form a bladder (10, 110, or 510) defining a peripheral chamber (16) and the heel chamber (18), optionally at least two additional chambers (a rear midfoot chamber (60) and a front midfoot chamber (62), optionally a forefoot chamber (64)), and optionally a groove (G1 or G2)) |
| 604 | Trim the bladder (10, 110, 510) along a perimeter flange (48) |
| 605 | Optionally, trim the bladder (110 or 510) along the groove (G1 or G2) to remove the at least two additional chambers from the bladder |
| 606 | Inflate the peripheral chamber (16) and the heel chamber (18) (and the optional additional chambers 60, 62 (bladders 110 and 510), and chamber 64 (bladder 110)) |
| 608 | Seal the peripheral chamber (16) and the heel chamber (18) so that the peripheral chamber and the heel chamber are fluidly isolated from one another |
| 610 | Seal the optional additional chambers 60, 62 (bladders 110 and 510), and chamber 64 (bladder 110) from the peripheral chamber 16, and optionally from the heel chamber 18 and/or from one another |

For bladders disclosed herein that are molded by blow molding, such as bladders 210, 310, and 410, a method of manufacturing footwear may include any or of the steps of the method 700 set forth in Table 2 below, as discussed herein.

TABLE 2

| 700-Method of Manufacturing Footwear | |
|---|---|
| 702 | Mold polymeric material by thermoforming to form a bladder (210, 310, or 410) defining a peripheral chamber (216, 416) and a heel chamber (218, 418) and, optionally (for bladder 310), at least two additional chambers (a rear midfoot chamber (60), a front midfoot chamber (62), and optionally a forefoot chamber (64)) |
| 704 | Trim the bladder (210, 310, 410), along a perimeter flange (at perimeter flange location 248, 448) |
| 706 | Seal the peripheral chamber (16) and the heel chamber (218, 418) so that the peripheral chamber and the heel chamber are fluidly isolated from one another |
| 708 | Seal the optional additional chambers (60, 62), and chamber 64 (bladder 310) from the heel chamber (218, 418), the peripheral chamber (16), and optionally from one another |

Accordingly, the bladders 10, 110, 210, 310, 410, and 510 disclosed herein have a unique combination of fluid-filled chambers that are shaped and configured to provide distinct cushioning profiles and support to different portions of a wearer's foot. In any of the embodiments described herein, a cushioning element could be used in place of the bladder 10, 110, 210, 310, 410, or 510, may have the same shape and features of the bladders 10, 110, 210, 310, 410, or 510, as described, and the cushioning element could instead be a foam material or another resiliently deformable material instead of a bladder with a fluid-filled chamber such as the fluid-filled peripheral chambers and the fluid-filled heel chambers described herein.

The following Clauses provide example configurations of sole structures, articles of footwear, and methods of manufacturing footwear as disclosed herein.

Clause 1. A sole structure for an article of footwear, the sole structure comprising: a bladder defining a fluid-filled peripheral chamber and a fluid-filled heel chamber; wherein the peripheral chamber is configured as an elongated tube, the peripheral chamber having a heel portion establishing a rear periphery of the bladder, a lateral arm portion extending from the heel portion and establishing a lateral periphery of the bladder, and a medial arm portion extending from the heel portion and establishing a medial periphery of the bladder; wherein the bladder includes webbing connecting the heel chamber to the peripheral chamber, with the heel chamber disposed between the medial arm portion and the lateral arm portion and forward of the peripheral chamber in a heel region of the bladder; and wherein the peripheral chamber and the heel chamber are sealed and are fluidly isolated from one another.

Clause 2. The sole structure of clause 1, wherein an elevation of the peripheral chamber in a heel region of the bladder is greater than an elevation of the heel chamber.

Clause 3. The sole structure of any of the preceding clauses, wherein the bladder includes a perimeter flange extending along the lateral periphery, the rear periphery, and the medial periphery of the bladder, and the perimeter flange is disposed nearer to a lowest extremity of the peripheral chamber at a ground-facing surface of the peripheral chamber than to a highest extremity of the peripheral chamber at a foot-facing surface of the peripheral chamber in the heel region of the bladder along the lateral periphery, the rear periphery, and the medial periphery.

Clause 4. The sole structure of any of the preceding clauses, wherein an inner wall of the peripheral chamber is steeper than an outer wall of the peripheral chamber at least directly outward of the heel chamber.

Clause 5. The sole structure of any of the preceding clauses, wherein the peripheral chamber is sealed and retains fluid at a first fluid pressure and the heel chamber is sealed and retains fluid at a second fluid pressure different than the first fluid pressure.

Clause 6. The sole structure of any of the preceding clauses, wherein the heel chamber is sealed and unpressurized and the peripheral chamber is sealed and unpressurized.

Clause 7. The sole structure of any of the preceding clauses, wherein the heel chamber and the peripheral chamber are the only fluid-filled chambers of the bladder.

Clause 8. The sole structure of any of the preceding clauses, wherein the bladder defines at least two additional fluid-filled chambers fluidly isolated from the peripheral chamber, the at least two additional fluid-filled chambers including a rear midfoot chamber and a front midfoot chamber, the rear midfoot chamber disposed between and connected to the heel chamber and the front midfoot chamber by the webbing, and the rear midfoot chamber and the front midfoot chamber connected to the lateral arm portion and the medial arm portion by the webbing.

Clause 9. The sole structure of any of the preceding clauses, wherein a periphery of the rear midfoot chamber is a convex, irregular quadrilateral with rounded corners, a rear side, a front side longer than the rear side, a medial side, and a lateral side longer than the medial side.

Clause 10. The sole structure of any of the preceding clauses, wherein a periphery of the front midfoot chamber is a convex, irregular quadrilateral with rounded corners, a rear side, a front side longer than the rear side, a medial side, and a lateral side shorter than the medial side.

Clause 11. The sole structure of any of the preceding clauses, wherein the bladder further defines a fluid-filled forefoot chamber, and the forefoot chamber is disposed forward of the front midfoot chamber and is connected only to the front midfoot chamber and the lateral arm portion by the webbing.

Clause 12. The sole structure of any of the preceding clauses, wherein the peripheral chamber, the heel chamber, the rear midfoot chamber, the front midfoot chamber, and the forefoot chamber are the only fluid-filled chambers of the bladder.

Clause 13. The sole structure of any of the preceding clauses, wherein: the lateral arm portion has a terminal end in a forefoot region of the bladder, and the medial arm portion has a terminal end rearward of the terminal end of the lateral arm portion; and a periphery of the forefoot chamber includes a lateral side extending parallel with the lateral arm portion, a rear side disposed forward of the terminal end of the medial arm portion and extending forwardly from a lateral extent to a medial extent, and a front side extending rearwardly from a lateral extent to a medial extent.

Clause 14. The sole structure of any of the preceding clauses, wherein the peripheral chamber, the heel chamber, the rear midfoot chamber, and the front midfoot chamber are the only fluid-filled chambers of the bladder.

Clause 15. The sole structure of any of the preceding clauses, wherein the bladder includes a groove extending between the medial arm portion and the front midfoot chamber, between the medial arm portion and the rear midfoot chamber, between a rear of the rear midfoot chamber and the heel chamber, between the rear midfoot chamber and the lateral arm portion, and between the front midfoot chamber and the lateral arm portion.

Clause 16. The sole structure of any of the preceding clauses, wherein the article of footwear includes an upper, and the sole structure further comprising: an outsole underlying the bladder; wherein the upper overlies the bladder; and wherein an exterior surface of the bladder is exposed between the upper and the outsole at the medial arm portion, the lateral arm portion, and the heel portion.

Clause 17. The sole structure of any of the preceding clauses, wherein the sole structure includes a midsole layer overlying the bladder between the upper and the bladder.

Clause 18. An article of footwear incorporating the sole structure of any of the preceding clauses.

Clause 19. An article of footwear of any of the preceding clauses, comprising: a sole structure that includes a bladder defining a cushioning element having a heel portion in a heel region of the sole structure and establishing a rear periphery of the cushioning element, a lateral arm portion extending from the heel portion and establishing a lateral periphery of the cushioning element, and a medial arm portion extending from the heel portion and establishing a medial periphery of the cushioning element; and wherein a terminal end of the medial arm portion is in a forefoot region of the sole structure and a terminal end of the lateral arm portion is in the forefoot region of the sole structure further forward than the terminal end of the medial arm portion.

Clause 20. The article of footwear of any of the preceding clauses, wherein the cushioning element is characterized by an absence of a medial forefoot portion.

Clause 21. The article of footwear of any of the preceding clauses, wherein the exterior side surface of the cushioning element is exposed along the medial arm portion from the heel portion to the terminal end of the medial arm portion.

Clause 22. The article of footwear of any of the preceding clauses, wherein the exterior side surface of the cushioning element is exposed along the lateral arm portion from the heel portion to the terminal end of the lateral arm portion.

Clause 23. The article of footwear of any of the preceding clauses, wherein the exterior side surface of the cushioning element is exposed along the heel portion.

Clause 24. The article of footwear of any of the preceding clauses, wherein the cushioning element includes a perimeter flange extending along the lateral periphery, the rear periphery, and the medial periphery of the cushioning element, and the perimeter flange is disposed nearer to a lowest extremity of the cushioning element at a ground-facing surface of the cushioning element than to a highest extremity of the cushioning element at a foot-facing surface of the cushioning element in the heel region of the cushioning element along the lateral periphery, the rear periphery, and the medial periphery.

Clause 25. The article of footwear of any of the preceding clauses, wherein the sole structure includes an outsole secured to a ground-facing surface of the cushioning element along the medial arm portion, the lateral arm portion, and the heel portion; and wherein the outsole extends to the perimeter flange.

Clause 26. The article of footwear of any of the preceding clauses, wherein the outsole terminates at the perimeter flange.

Clause 27. The article of footwear of any of the preceding clauses, wherein the sole structure includes a midsole layer disposed in the forefoot region forward of the terminal end of the medial arm portion and forward of the terminal end of the lateral arm portion; and wherein the midsole layer is further disposed in a midfoot region of the sole structure and in the heel region and extends over the lateral arm portion, the medial arm portion, and the heel portion without covering the exterior side surface.

Clause 28. The article of footwear of any of the preceding clauses, wherein the sole structure includes an outsole secured to a ground-facing surface of the cushioning element along the medial arm portion, the lateral arm portion, and the heel portion, and secured to the midsole layer forward of the terminal end of the medial arm portion and forward of the terminal end of the lateral arm portion.

Clause 29. The article of footwear of any of the preceding clauses, further comprising an upper; wherein the upper overlies the midsole layer and the midsole layer is between the upper and the cushioning element.

Clause 30. A method of manufacturing footwear of any of the preceding clauses, the method comprising: molding polymeric material to form a bladder for a sole structure of an article of footwear, the bladder defining a fluid-filled peripheral chamber and a fluid-filled heel chamber; wherein the peripheral chamber is configured as an elongated tube, the peripheral chamber having a heel portion establishing a rear periphery of the bladder, a lateral arm portion extending from the heel portion and establishing a lateral periphery of the bladder, and a medial arm portion extending from the heel portion and establishing a medial periphery of the bladder; wherein the bladder includes webbing connecting the heel chamber to the peripheral chamber, with the heel chamber disposed between the medial arm portion and the lateral arm portion and forward of the peripheral chamber in a heel region of the bladder; and sealing the peripheral chamber and the heel chamber so that the peripheral chamber and the heel chamber are fluidly isolated from one another.

Clause 31. The method of manufacturing footwear of any of the preceding clauses, further comprising: inflating the peripheral chamber and the heel chamber before sealing the peripheral chamber and the heel chamber so that the peripheral chamber retains fluid at a first fluid pressure and the heel chamber retains fluid at a second fluid pressure different than the first fluid pressure.

Clause 32. The method of manufacturing footwear of any of the preceding clauses, further comprising: trimming the polymeric material at a perimeter flange extending along the lateral periphery, the rear periphery, and the medial periphery of the bladder, the perimeter flange disposed nearer to a lowest extremity of the peripheral chamber at a ground-facing surface of the peripheral chamber than to a highest extremity of the peripheral chamber at a foot-facing surface of the peripheral chamber in the heel region of the bladder along the lateral periphery, the rear periphery, and the medial periphery.

Clause 33. The method of manufacturing footwear of any of the preceding clauses, wherein the bladder further defines: at least two additional chambers fluidly isolated from the peripheral chamber, the at least two additional chambers including a rear midfoot chamber and a front midfoot chamber, the rear midfoot chamber disposed between and connected to the heel chamber and the front midfoot chamber by the webbing, and the rear midfoot chamber and the front midfoot chamber connected to the lateral arm portion and the medial arm portion by the webbing; and a groove extending between the medial arm portion and the front midfoot chamber, between the medial arm portion and the rear midfoot chamber, between a rear of the rear midfoot chamber and the heel chamber, between the rear midfoot chamber and the lateral arm portion, and between the front midfoot chamber and the lateral arm portion; and the method of manufacturing further comprising: trimming the bladder along the groove to remove the at least two additional chambers from the bladder.

Clause 34. A sole structure for an article of footwear of any of the preceding clauses, the sole structure comprising: a bladder defining a peripheral chamber and a heel chamber; wherein the peripheral chamber is configured as an elongated tube, the peripheral chamber having a heel portion establishing a rear periphery of the bladder, a lateral arm portion extending from the heel portion and establishing a lateral periphery of the bladder, and a medial arm portion extending from the heel portion and establishing a medial periphery of the bladder; wherein the bladder includes webbing connecting the heel chamber to the peripheral chamber, with the heel chamber disposed between the medial arm portion and the lateral arm portion and forward of the peripheral chamber in a heel region of the bladder; and wherein the peripheral chamber and the heel chamber are fluidly isolated from one another.

Clause 35. The sole structure of any of the preceding clauses, wherein the peripheral chamber is sealed and retains fluid at a first fluid pressure and the heel chamber is sealed and retains fluid at a second fluid pressure different than the first fluid pressure.

Clause 36. The sole structure of any of the preceding clauses, wherein the lateral arm portion has a terminal end in a forefoot region of the bladder, and the medial arm portion has a terminal end rearward of the terminal end of the lateral arm portion.

Clause 37. The sole structure of any of the preceding clauses, wherein the webbing terminates rearward of the forefoot region of the bladder.

Clause 38. The sole structure of any of the preceding clauses, wherein the heel chamber and the peripheral chamber are the only chambers of the bladder.

Clause 39. The sole structure of any of the preceding clauses, wherein the bladder defines three additional chambers fluidly isolated from the peripheral chamber, the three additional chambers including a rear midfoot chamber, a front midfoot chamber, and a forefoot chamber, the rear midfoot chamber disposed between and connected to the heel chamber and the front midfoot chamber by the webbing, the rear midfoot chamber and the front midfoot chamber connected to the lateral arm portion and the medial arm portion by the webbing, and the forefoot chamber disposed forward of the front midfoot chamber and connected to only the front midfoot chamber and the lateral arm portion by the webbing.

Clause 40. The sole structure of any of the preceding clauses, wherein a periphery of the rear midfoot chamber is a convex, irregular quadrilateral with rounded corners, a rear side, a front side longer than the rear side, a medial side, and a lateral side longer than the medial side.

Clause 41. The sole structure of any of the preceding clauses, wherein a periphery of the front midfoot chamber is a convex, irregular quadrilateral with rounded corners, a rear side, a front side longer than the rear side, a medial side, and a lateral side shorter than the medial side.

Clause 42. The sole structure of any of the preceding clauses, wherein the rear side of the front midfoot chamber is parallel with the front side of the rear midfoot chamber.

Clause 43. The sole structure of any of the preceding clauses, wherein: the lateral arm portion has a terminal end in a forefoot region of the bladder, and the medial arm portion has a terminal end rearward of the terminal end of the lateral arm portion; and a periphery of the forefoot chamber includes a lateral side extending parallel with the lateral arm portion, a rear side disposed forward of the terminal end of the medial arm portion and extending forwardly from a lateral extent to a medial extent, and a front side extending rearwardly from a lateral extent to a medial extent.

Clause 44. The sole structure of any of the preceding clauses, wherein a forward edge of the bladder extends along a front side of the front midfoot chamber and along the front side of the forefoot chamber.

Clause 45. The sole structure of any of the preceding clauses, wherein: the lateral arm portion has a terminal end in a forefoot region of the bladder, and the medial arm portion has a terminal end rearward of the terminal end of the lateral arm portion; and the forward edge of the bladder is rearward of a line tangent to the terminal end of the lateral arm portion and the terminal end of the medial arm portion.

Clause 46. The sole structure of any of the preceding clauses, wherein a majority of the forefoot chamber is disposed between the lateral arm portion of the peripheral chamber and a longitudinal midline of the bladder.

Clause 47. The sole structure of any of the preceding clauses, wherein a lateral side of the forefoot chamber, a lateral side of the front midfoot chamber, and a lateral side of the rear midfoot chamber are equidistant from the lateral arm portion.

Clause 48. The sole structure of any of the preceding clauses, wherein a medial side of the front midfoot chamber and a medial side of the rear midfoot chamber are equidistant from the medial arm portion.

Clause 49. The sole structure of any of the preceding clauses, wherein the bladder includes: a first channel extending between and fluidly connecting the forefoot chamber and the front midfoot chamber; and a second channel extending between and fluidly connecting the front midfoot chamber and the rear midfoot chamber.

Clause 50. The sole structure of any of the preceding clauses, wherein the bladder includes a third channel extending between and fluidly connecting the rear midfoot chamber and the heel chamber.

Clause 51. The sole structure of any of the preceding clauses, wherein each of the forefoot chamber, the front midfoot chamber, and the rear midfoot chamber are fluidly isolated from one another and from the heel chamber.

Clause 52. The sole structure of any of the preceding clauses, wherein the bladder includes a single fill port extending from a front side of the front midfoot chamber.

Clause 53. The sole structure of any of the preceding clauses, wherein the article of footwear includes an upper, and the sole structure further comprising: an outsole underlying the bladder; wherein the upper overlies the bladder; and wherein an exterior surface of the bladder is exposed between the upper and the outsole at the medial arm portion, the lateral arm portion, and the heel portion.

Clause 54. The sole structure of any of the preceding clauses, wherein: the bladder includes a first polymeric sheet and a second polymeric sheet defining the peripheral chamber, the heel chamber, the webbing, and a perimeter flange at the medial periphery, the lateral periphery, and the rear periphery, the first polymeric sheet and the second polymeric sheet bonded to one another at the webbing and the perimeter flange and separated from one another at the heel chamber and the peripheral chamber.

Clause 55. The sole structure of any of the preceding clauses, wherein the bladder is characterized by an absence of a medial forefoot portion.

Clause 56. A sole structure for an article of footwear of any of the preceding clauses, the sole structure comprising: a bladder defining a peripheral chamber, only one heel chamber, only two midfoot chambers including a front midfoot chamber and a rear midfoot chamber, and only one forefoot chamber; wherein the peripheral chamber is configured as an elongated tube having a heel portion extending establishing a rear periphery of the bladder, a lateral arm portion extending from the heel portion and establishing a lateral periphery of the bladder, and a medial arm portion extending from the heel portion and establishing a medial periphery of the bladder; wherein the bladder includes webbing connecting: the heel chamber to the heel portion, the lateral arm portion, and the medial arm portion of the peripheral chamber; the rear midfoot chamber and the front midfoot chamber to the lateral arm portion, to the medial arm portion, and to one another; and the forefoot chamber only to the lateral arm portion and the front midfoot chamber; and wherein the peripheral chamber and the heel chamber are fluidly isolated from one another.

Clause 57. The sole structure of any of the preceding clauses, wherein: a periphery of the rear midfoot chamber is a convex, irregular quadrilateral with rounded corners, a rear side, a front side longer than the rear side, a medial side, and a lateral side longer than the medial side; a periphery of the front midfoot chamber is a convex, irregular quadrilateral with rounded corners, a rear side, a front side longer than the rear side, a medial side, and a lateral side shorter than the medial side; and a majority of the forefoot chamber is disposed between the lateral arm portion and a longitudinal midline of the bladder.

Clause 58. The sole structure of any of the preceding clauses, wherein: the lateral arm portion has a terminal end in a forefoot region of the bladder, and the medial arm portion has a terminal end rearward of the terminal end of the lateral arm portion; and a periphery of the forefoot chamber includes a lateral side extending parallel with the lateral arm portion, a rear side disposed forward of the terminal end of the medial arm portion and extending forwardly from a lateral extent to a medial extent, and a front side extending rearwardly from a lateral extent to a medial extent.

Clause 59. The sole structure of any of the preceding clauses, wherein a forward edge of the bladder extends along the front side of the front midfoot chamber and along the front side of the forefoot chamber.

Clause 60. The sole structure of any of the preceding clauses, wherein each of the forefoot chamber, the front midfoot chamber, and the rear midfoot chamber are fluidly isolated from one another and from the heel chamber and the peripheral chamber.

Clause 61. The sole structure of any of any of the preceding clauses, wherein each of the forefoot chamber, the front midfoot chamber, and the rear midfoot chamber are in fluid communication with one another and with the heel chamber and are fluidly isolated from the peripheral chamber.

Clause 62. The sole structure of any of the preceding clauses, wherein the bladder is characterized by an absence of a medial forefoot portion.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A method of manufacturing, the method comprising:

molding polymeric material to form a bladder for a sole structure of an article of footwear, the bladder defining a peripheral chamber, a heel chamber, and at least one additional chamber;

wherein the peripheral chamber has a heel portion establishing a rear periphery of the bladder, a lateral arm portion extending from the heel portion and establishing a lateral periphery of the bladder, and a medial arm portion extending from the heel portion and establishing a medial periphery of the bladder;

wherein the bladder includes webbing connecting the heel chamber to the peripheral chamber and connecting the at least one additional chamber to the heel chamber and to the peripheral chamber, with the heel chamber disposed between the medial arm portion and the lateral arm portion and forward of the peripheral chamber in a heel region of the bladder;

wherein the bladder includes a groove in the webbing, the groove extending between the medial arm portion and the at least one additional chamber, rearward of the at least one additional chamber, and between the at least one additional chamber and the lateral arm portion; and trimming the bladder along the groove to remove the at least one additional chamber from the bladder.

2. The method of claim 1, wherein the bladder is a first bladder, the sole structure is a first sole structure, the article of footwear is a first article of footwear, and said molding is in a first mold, and the method further comprising:

molding polymeric material in the first mold to form a second bladder for a second sole structure of a second article of footwear, wherein the second bladder includes a peripheral chamber, a heel chamber, at least one additional chamber, webbing, and a groove identical to the peripheral chamber, the heel chamber, the at least one additional chamber, the webbing, and the groove of the first bladder;

incorporating the first bladder into the first sole structure of the first article of footwear after said trimming; and incorporating the second bladder into the second sole structure of the second article of footwear without trimming at the groove of the second bladder.

3. The method of claim 1, wherein the polymeric material includes a first polymeric sheet and a second polymeric sheet, and the method further comprising:

disposing anti-weld material between the first polymeric sheet and the second polymeric sheet prior to said molding to prevent sealing of the polymeric sheets to one another during said molding at channels extending between the peripheral chamber and the at least one additional chamber and extending between the heel chamber and the at least one additional chamber.

4. The method of claim 3, wherein one or more of the channels are sealed after said molding.

5. The method of claim 1, further comprising:

sealing the peripheral chamber and the heel chamber so that the peripheral chamber and the heel chamber are fluidly isolated from one another.

6. The method of claim 5, further comprising:

prior to said trimming of the bladder, inflating the peripheral chamber and the heel chamber;

sealing a channel at the heel chamber;

continuing to inflate the peripheral chamber or releasing fluid from the peripheral chamber; and sealing a channel at the peripheral chamber so that the peripheral chamber is a fluid-filled chamber that retains fluid at a first fluid pressure and the heel chamber is a fluid-filled chamber that retains fluid at a second fluid pressure different than the first fluid pressure.

7. The method of claim 6, wherein inflating the peripheral chamber and the heel chamber is via a fill port of the at least one additional chamber such that inflating the peripheral chamber and the heel chamber further includes inflating the at least one additional chamber, and the method further comprising:

sealing a channel that extends between the at least one additional chamber and the peripheral chamber so that the at least one additional chamber is a fluid-filled chamber that retains fluid at a different pressure than the peripheral chamber.

8. The method of claim 1, wherein the bladder includes a channel connecting the peripheral chamber and the at least one additional chamber, and a channel connecting the at least one additional chamber and the heel chamber, and the method further comprising:

prior to said trimming of the bladder, inflating the peripheral chamber, the heel chamber, and the at least one additional chamber with fluid using only a single fill port at the at least one additional chamber.

9. The method of claim 8, further comprising:

sealing the channel connecting the peripheral chamber and the at least one additional chamber and/or sealing the channel connecting the at least one additional chamber and the heel chamber following said inflating thereby forming at least one sealed channel and isolating the chambers connected by the at least one sealed channel.

10. The method of claim 1, further comprising:

trimming the polymeric material at a perimeter flange extending along the lateral periphery, the rear periphery, and the medial periphery of the bladder, the perimeter flange disposed nearer to a lowest extremity of the peripheral chamber at a ground-facing surface of the peripheral chamber than to a highest extremity of the peripheral chamber at a foot-facing surface of the peripheral chamber in the heel region of the bladder along the lateral periphery, the rear periphery, and the medial periphery.

11. The method of claim 1, wherein the at least one additional chamber is at least two additional chambers fluidly isolated from the peripheral chamber, the at least two additional chambers including a rear midfoot chamber and a front midfoot chamber, the rear midfoot chamber disposed between and connected to the heel chamber and the front midfoot chamber by the webbing, and the rear midfoot chamber and the front midfoot chamber connected to the lateral arm portion and the medial arm portion by the webbing;

wherein the groove extends between the medial arm portion and the front midfoot chamber, between the medial arm portion and the rear midfoot chamber, between a rear of the rear midfoot chamber and the heel chamber, between the rear midfoot chamber and the lateral arm portion, and between the front midfoot chamber and the lateral arm portion; and wherein said trimming the bladder along the groove removes the at least two additional chambers from the bladder.

12. The method of claim 11, wherein the at least two additional chambers further include a forefoot chamber disposed forward of the front midfoot chamber and connected only to the front midfoot chamber and the lateral arm portion by the webbing; and wherein the groove extends between the lateral arm portion and the forefoot chamber such that said trimming the bladder along the groove removes the forefoot chamber from the bladder.

13. The method of claim 12, wherein the peripheral chamber, the heel chamber, the rear midfoot chamber, the front midfoot chamber, and the forefoot chamber are the only chambers of the bladder.

14. The method of claim 1, wherein the bladder includes a perimeter flange extending along the lateral periphery, the rear periphery, and the medial periphery of the bladder;

wherein the perimeter flange is disposed nearer to a lowest extremity of the bladder at a ground-facing surface of the bladder than to a highest extremity of the bladder at a foot-facing surface of the bladder in the heel region of the bladder along the rear periphery; and the method further comprising:

securing an outsole to the ground-facing surface of the bladder along the medial arm portion, the lateral arm portion, and the heel portion; and wherein the outsole extends to the perimeter flange.

15. The method of claim 1, further comprising:

disposing a midsole layer in a forefoot region of the sole structure forward of a terminal end of the medial arm portion and forward of a terminal end of the lateral arm portion; and wherein the midsole layer is further disposed in a midfoot region of the sole structure and in the heel region and extends over the lateral arm portion, the medial arm portion, and the heel portion without covering an exterior side surface of the bladder.

16. The method of claim 15, further comprising:

securing an outsole to a ground-facing surface of the bladder along the medial arm portion, the lateral arm portion, and the heel portion.

17. The method of claim 16, further comprising:

securing the outsole to the midsole layer forward of the terminal end of the medial arm portion and forward of the terminal end of the lateral arm portion.

18. The method of claim 15, further comprising:

securing a footwear upper to the midsole layer such that the midsole layer is between the footwear upper and the bladder.

* * * * *